US006418823B1

(12) United States Patent
Taitler

(10) Patent No.: US 6,418,823 B1
(45) Date of Patent: Jul. 16, 2002

(54) PROCESSING CENTER FOR THREE DIMENSIONAL CUTTING OF FOOD PRODUCTS

(75) Inventor: Isaac Taitler, Haifa (IL)

(73) Assignee: Tairob Industrial Technology Ltd., Haifa (IL)

( * ) Notice: Subject to any disclaimer, the term of this patent is extended or adjusted under 35 U.S.C. 154(b) by 0 days.

(21) Appl. No.: 09/318,926

(22) Filed: May 26, 1999

(51) Int. Cl.[7] ..... B26D 1/00; B26D 7/06

(52) U.S. Cl. ..... 83/36; 83/100; 83/23; 83/167; 83/165; 83/435.15; 83/437.3; 83/627

(58) Field of Search ..... 83/932, 404.2, 83/36, 915.3, 733, 404.3, 419, 859, 547, 100, 167, 165, 435.15, 437.3, 627; 53/515, 514, 513, 1

(56) References Cited

U.S. PATENT DOCUMENTS 2,303,595 A * 12/1942 Young ..... 83/404.4
3,096,583 A * 7/1963 Nevin ..... 83/404.2
3,685,519 A * 8/1972 Cover et al. ..... 83/932
4,031,789 A * 6/1977 Soodalter ..... 83/404.2
4,175,690 A * 11/1979 Bova et al. ..... 83/404.3
4,381,687 A * 5/1983 Reifenhauser ..... 83/404.3
4,428,263 A * 1/1984 Lindee et al. ..... 83/422
4,565,053 A * 1/1986 Browne et al. ..... 83/411
5,423,238 A * 6/1995 Bory ..... 83/36
5,640,897 A * 6/1997 Fehr ..... 83/932
5,649,463 A * 7/1997 Lindee et al. ..... 83/932
6,070,509 A * 6/2000 Lonn et al. ..... 83/932
6,013,288 A * 8/2000 Kobayashi et al. ..... 83/932

* cited by examiner

*Primary Examiner*—Boyer Ashley
*Assistant Examiner*—Omar Flores-Sánchez
(74) *Attorney, Agent, or Firm*—Mark M. Friedman

(57) ABSTRACT

The present invention refers to a processing center for automatic food treatment without human intervention throughout the process. Various food products like vegetables or fruits are placed within the storage compartments of the apparatus and, depending on apriori preprogrammed parameters, are automatically cut in 3 dimensions. The desired 3D cut is obtained by the following cutting steps:

1. Slicing of the product.
2. Horizontal cutting of sliced product.
3. Vertical cutting of sliced product.

Various possibilities are established by the above process so as to allow preparation of ready made salads with predetermined size of cut components like onion, cucumber, tomato, radish, banana, apple, orange, melon, etc.

The apparatus is equipped with motion converting mechanisms, multimode control and with approppiate computerized control means. It is possible to combine the present apparatus with the seasoning center for liquid or powdered seasoning like oil or salt, as is described in my pending patent application IL122104: "Seasoning Center for automatic dispensing of granular, powdered or liquid seasoning products."

19 Claims, 29 Drawing Sheets

PROCESSING CENTER FOR THREE DIMENSIONAL CUTTING OF FOOD PRODUCTS

BACKGROUND OF THE INVENTION

The next generation of food treatment apparatus encompasses high tech utensils in order to facilitate the preparation of food, to save expensive time and extra labour.

A desired slice geometry of eggplant, potato, apple or other food products, cutting thereof without comminution, may be obtained by virtue of the present invention.

The user of the processing center is required interactively to enter selected mode of cutting and 3 dimensions of the products to be cut. The data is stored in apparatus memory for automatic program execution. The present invention, which intends to overcome traditional methods of preparation associated with food handling and time wasting will result in fast, fresh and tasty food. Fast food, saturated with canned goods, constitutes a significant part of our every day food menu. This type of food has an advantage due to its simple preparation process, which is cheap and time saving. However, esthetic shape and fresh aroma of the food product are missing.

The proposed apparatus saves extended preparation time, caused by manual cutting of food products and involving plates, knives, trays and other accessories that will remain nostalgic memories. After the cut process is terminated, pressing of a button will effect liquid or powdered seasoning executed automatically, for example by virtue of a seasoning center as per pending patent application IL122104.

Significant profit for restaurants can be achieved, where clients can obtain their favourite tasty salad. The variety of products which a restaurant would be able to offer its clients, by virtue of the present invention, will be significantly superior to what is available at present. Sanitary processing of vegetables and fruits will be made possible by the present process, thus avoiding human involvement.

We do not know similar food centers for food preparation.

Of those known in the art, food centers are capable of performing only a minor part of the various activities and operations which are possible with the apparatus of the present invention:

Those known in the art devices usually comprise a cabinet provided with a rotary blade suitable for slicing of 2 or 3 products. The sliced food pieces are obtained without the possibility to predetermine shape and size. Sometimes the cut products are split into unesthetic shapes. At the end of the cutting process, the products have to be removed and placed in a separate container for seasoning and mixing. It is impossible to prepare a fruit salad (due to total squashing of the fruits) or get a potato chips with desired shape and size.

There are known also manually operated devices for different activities: special slice cutter, potato slicer, etc. Furthermore there is also the electrical food processor or mixer with different attachments enabling convienent mixing. However, this processor has significant disadvantages in comparison to the proposed invention:

1. The known food processor comprises a working metal disk provided with a groove above its knife. Applying pressure on the food product to be cut against the disk will cause a slice cut depending on the width of the groove. For a longer or narrower width of slice, the user has to open the food processor housing and to replace the working disk. Therefore the cutting possibilities are limited according to the number of available disks.

The size of a slice is also limited by the narrow entry to the cutting device, thus precluding the possibility to slice an entire egg, eggplant, etc. The narrow entry also causes damage to the food product(partial cut), and thus an unesthetic appearance. The above activity encompasses immense additional manual work and environmental disturbances (kitchen utensils and cleaning).
2. In the known in the art devices there is no possibility to obtain a predetermined length or height of a slice cut, neither the possibility for obtaining potato chips with a predetermined and uniform size. Salad products cut by a known food processor are mainly split in random and non-uniform shapes. The traditional food processor causes comminution of the food products, associated with a total disruption of the normal structure. There is no possibility of a uniform cut.
3. The known food processor can process a product only when it is manually pressed by a plastic pusher against the cutting means. There is no possibility for automatic feeding of various food products within the cutting zone without human intervention.
4. The traditional food processor cannot be programmed for a plurality of processing activities, either associated with one product or various products. Cutting of cabbage into thin slices needs a dedicated slicing disk which differs from that required for cutting eggplant into slices, thus additional time consuming operation is required for replacing the disk.
5. Another disadvantage of the known processor is associated with the lack of possibility of connecting a manual food processor to an automatic computerized seasoning center, as per my pending patent application IL122104. Therefore, additional labour and time is required for adding taste to food.

DETAILED DESCRIPTION OF THE PREFERRED EMBODIMENTS

Figure 1A:
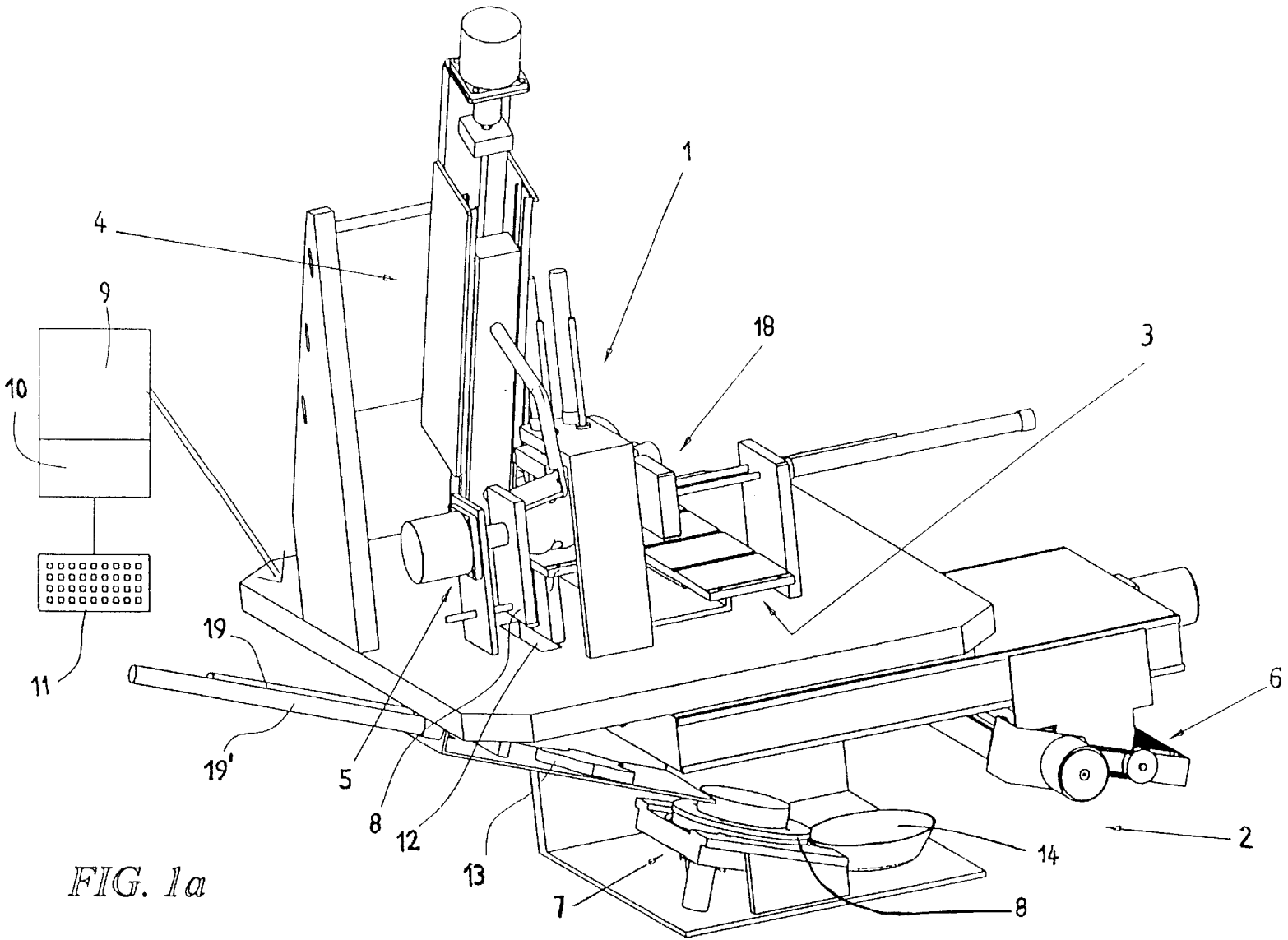
FIG. 1*a* shows a general view of the processing center, including its main components.

FIG. 1*a* shows the 3D food product cutter with all its main components:

The entry and slice cutter unit 1 for conveying, holding, cutting and passing a cut food product slice to the horizontal and vertical cutting unit 2.

The slice cutter unit 1 consists of an entry product conveyer 3, a slice cutter 4 and a slice width adjuster 5. The user may adjust, as an apriori set of cutting, parameters which are similar or dissimilar to the products to be cut. This option may cause similar cuts for all products without limitation on products quantity at the food center's entry.

The present invention is not limited to the food products. The apparatus also can be used for cutting other materials, including super conductive materials or various soft materials.

The horizontal and vertical cutting unit 2 consists of a cutting head 6, a working rotary table 7, slice supply means and final slice cut storage means. The sliced product 13 falls through an opening 12 on a shelf for further transfer to the rotary working table 7, where a first horizontal cut is obtained through multicut operation of the cutting head 6, then the rotary working table is rotated 90 degrees for a second multicut of the cutting head, so obtaining a complete 3D product cut.

The cut product's pieces are then transferred to the output container 14, where automatic seasoning may be obtained, for example, by a seasoning center as described in my previous patent application IL122104.

Figure 22:
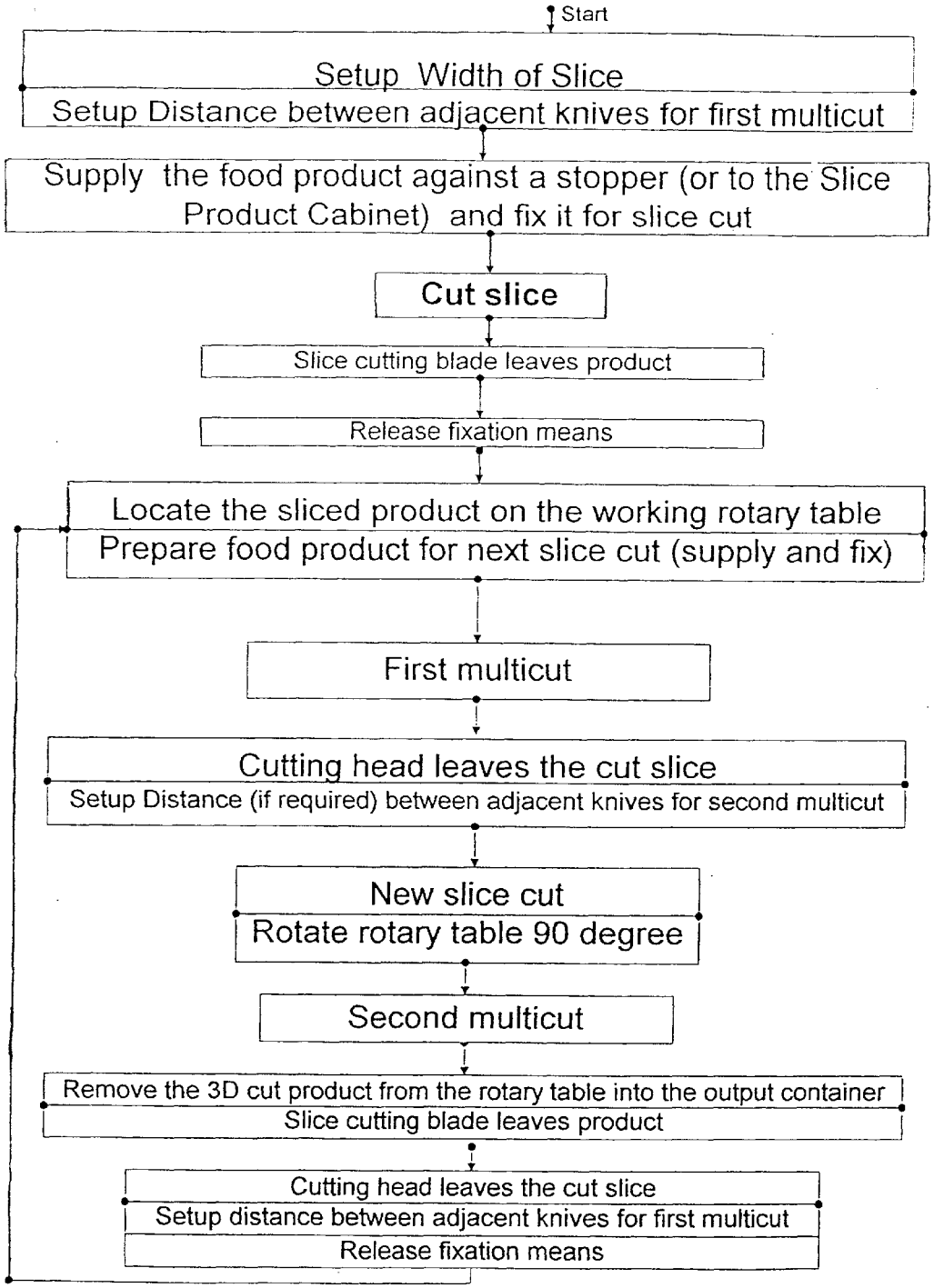
FIG. 22 shows a flow chart describing the 3D cut process.

A flow chart diagram for 3D cut is given in FIG. 22, where slice cut, horizontal cut and vertical cut are described by a block diagram process. With respect to the flow chart of FIG. 22, a food product conveyed to the entry of the feeder (shown in FIGS. 1*a*, 2) is sliced by a cutting blade, after several setup preparations. The slice is then supplied to a working rotary table, where a first multicut is obtained by a cutting head provided with a plurality of knives. Ending the first multicut leads to a new slice cut and to a 90 degree rotation of the working table. A second multicut is then performed. The 3D cut product is removed from the working table into the output container leading to a new cutting cycle. It should be understood that the given flow chart represents a short summary of the 3D process involving various software routines and hardware activity not given in detail in the flow chart of FIG. 22.

Figure 21:
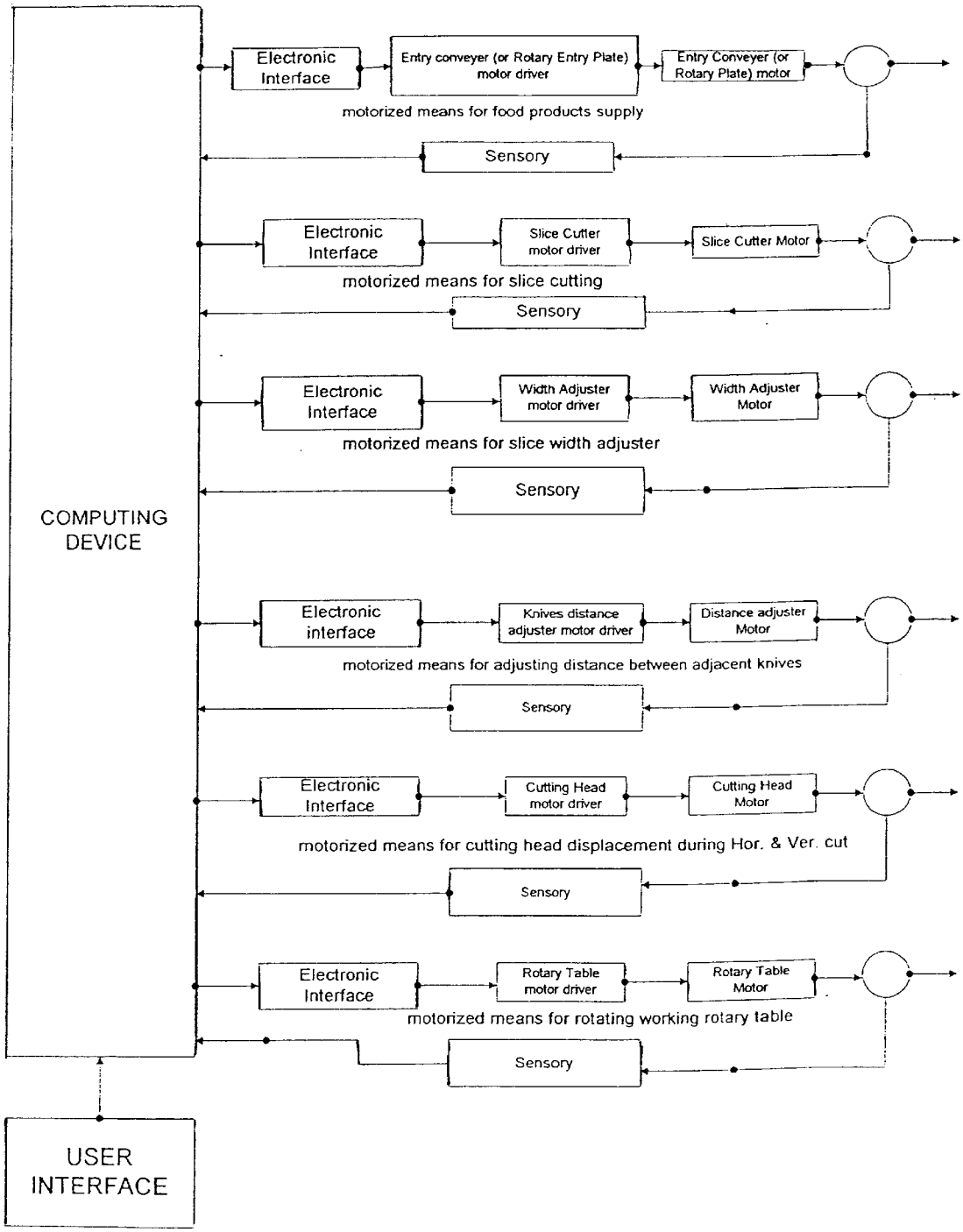
FIG. 21 shows a block diagram of the electric control system.

Separate and independent control is provided for 3D cutting mode. The cut parameters are defined by a human operator, based on his knowledge and taste experience. Detailed operating parameters are maintained in a suitable memory means and can be polled by a computing device during operation of the apparatus. The apparatus is incorporated with various sensors, microswitches, or other means, required for use in feedback control process for controlling the apparatus within its functioning. The electrical control is in general presented in a flow chart diagram shown in FIG. 21, where the motorized means are close loop controlled for high valued performance and robustness.

With respect to FIG. 1*a*, the apparatus is equipped with sensors 8 or other measurement means at different places (most of them not drawn, however the skilled in the art person should know how properly to choose them and to incorporate in the apparatus of the present invention), for alarm, limit switch and performance sensing and measuring.

Figure 23:
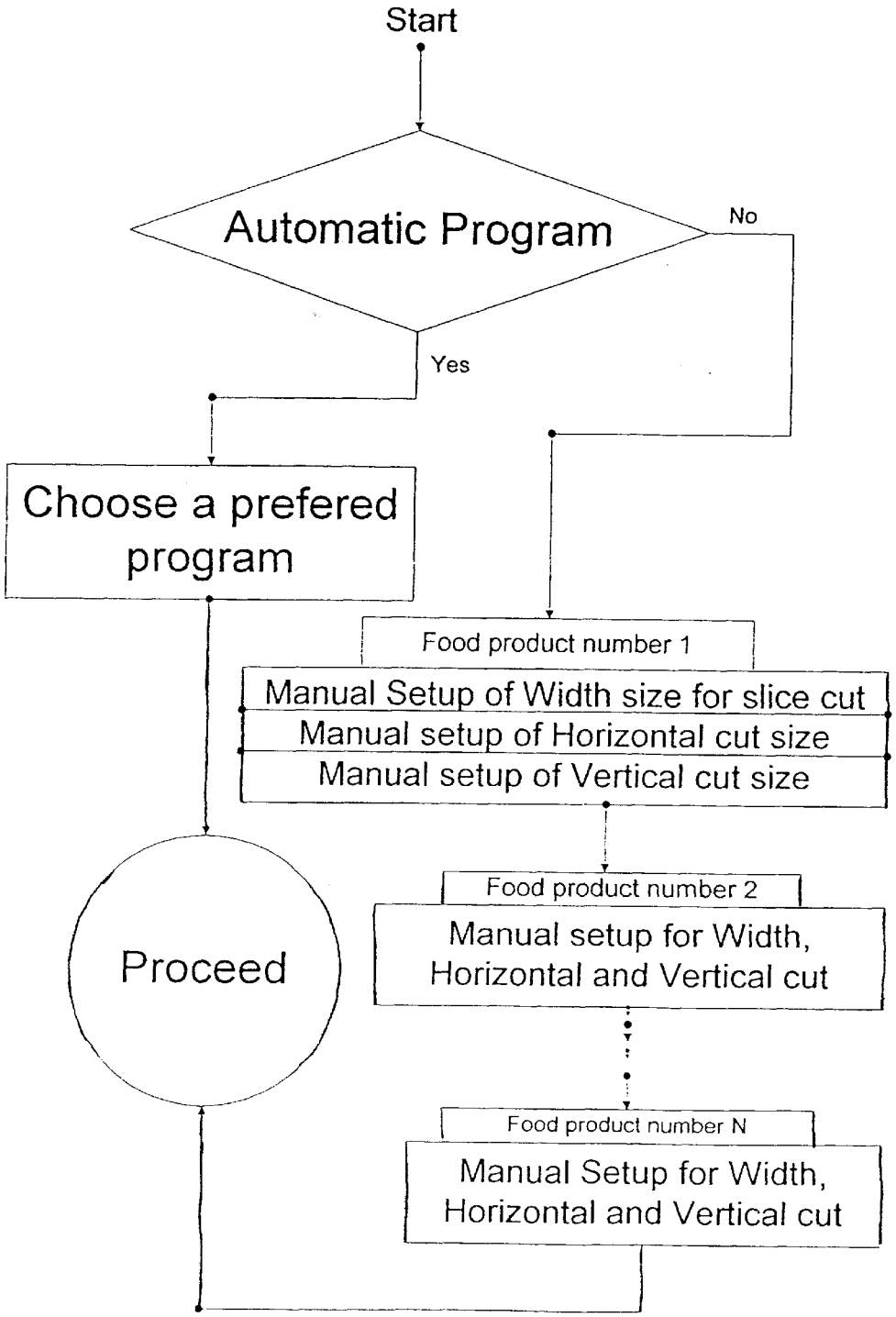
FIG. 23 shows a flow chart describing the user interface facility.

The sensory information is transmitted to the computing means 9 through the control and electronic circuits 10. Control means are used to apply the computed parameters to the motor through suitable motor drivers (not shown). A friendly user/operator programmable interface 11 may be used for an automatic cut program or manual operation for applying 3D cut parameters. A user interface flow chart is given in FIG. 23, where a user may preffer an automatic preprogrammed ready to use program or program 3D cut parameters for an arbitrary product to be cut.

Figure 1B:
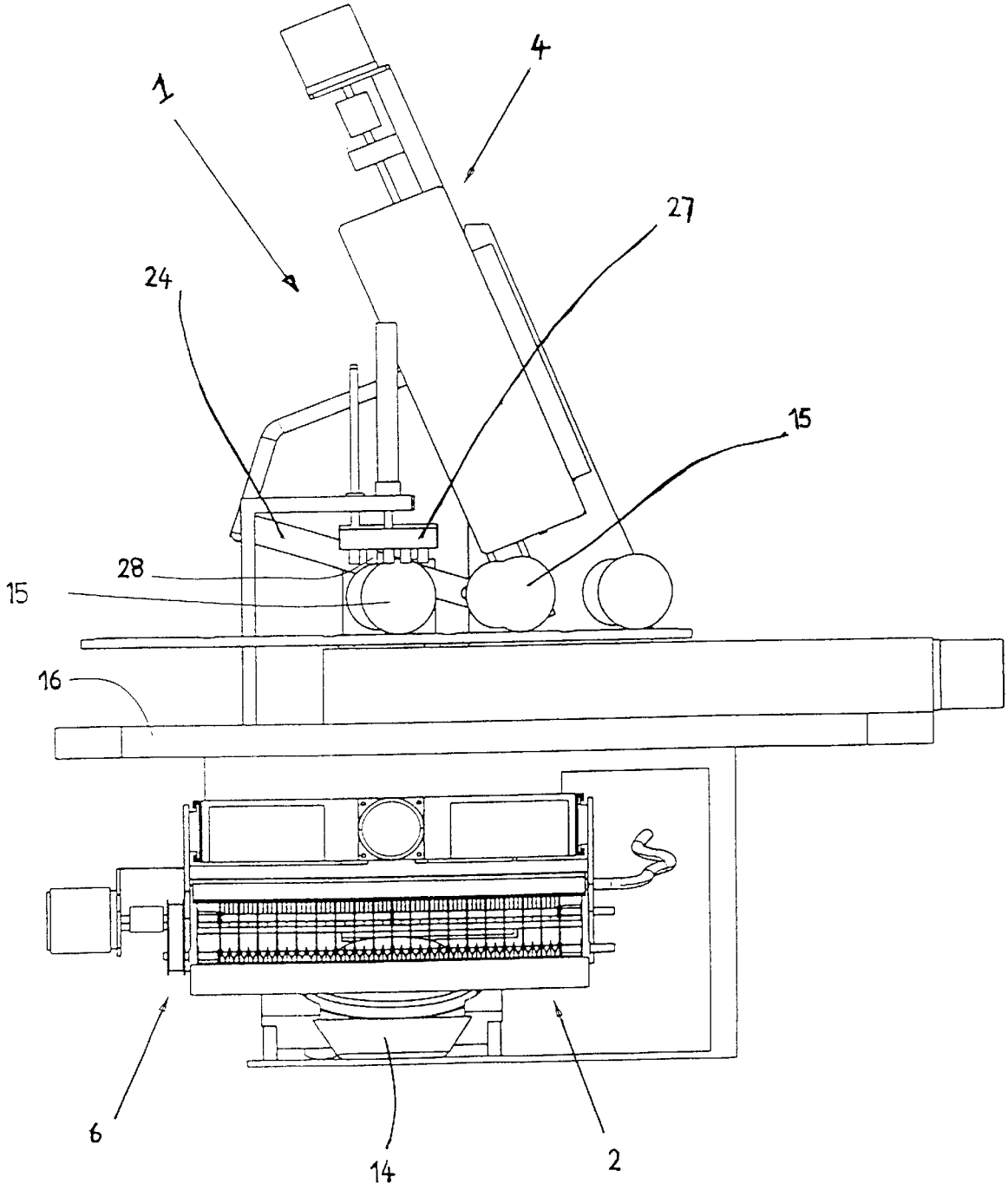
FIG. 1*b* shows a side view of the center shown in FIG. 1*a*.

FIG. 1*b* shows the apparatus from FIG. 1*a*, rotated 90 degrees, for a detailed slice cut of an arbitrary food product 15, where the slice cut unit 1 is keyed to the housing 16 which departs between the slice cut unit 1 and the horizontal and vertical cutting unit 2.

Figure 2:
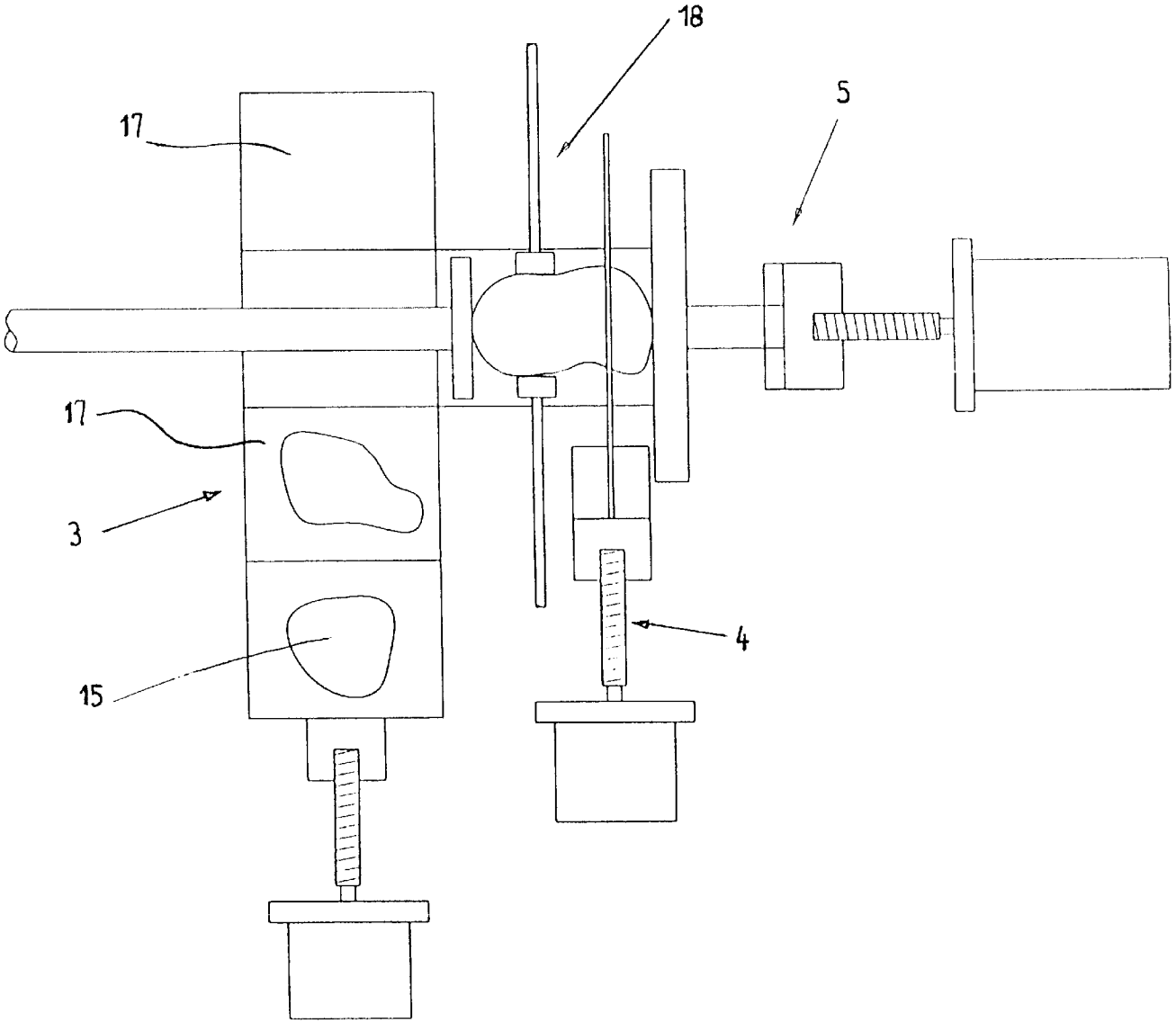
FIG. 2 shows a schematic top view of the slicing unit including an entry, holding pistons, slice cutter and slice width adjusting means.

With respect to FIG. 2 a user locates manually different food products in compartments 17 residing on the entry conveyer 3.

Figure 3:
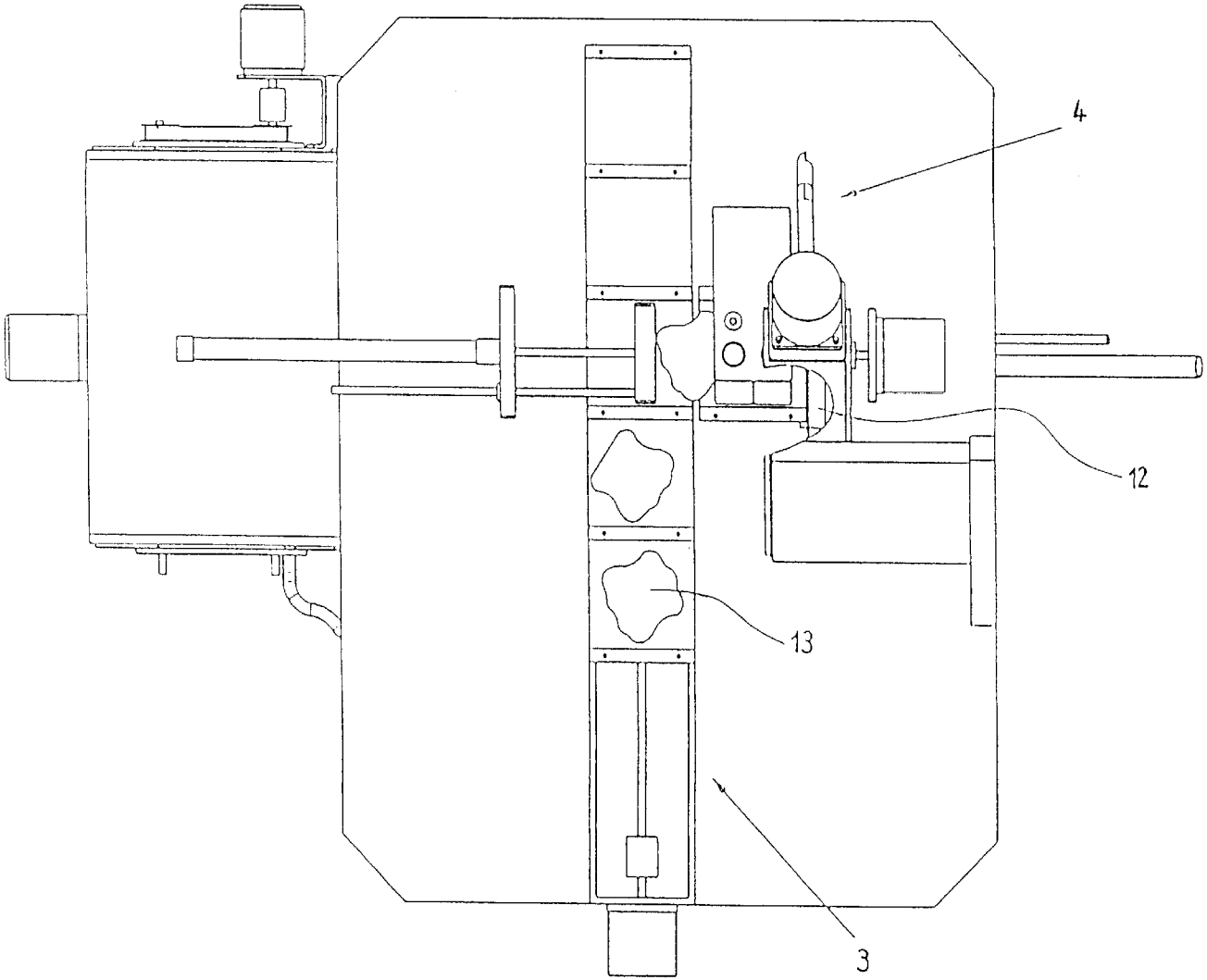
FIG. 3 shows a top view of the slicing unit residing on a table including the entry conveyor and holding pistons, slice cutter, slice width adjuster and an opening for transferring the cut slice to the next process station.

The processing center comprises a user entry product conveyer 3 for passing and locating the food products and a product feeder 18 means for holding and supplying the food product to the slice cutting unit 4 as shown in the schematic view of FIG. 2 and in an upper view of the apparatus in FIG. 3.

The conveyer is provided with compartments 17 for conveying the food product to an entry of a cutting plane, where the product is prepared for slice cutting by fixation means. The sliced food product is passed through the opening 12 (FIG. 3) and is pushed to the rotary cutting table 7 by the dynamic slice product remover 19 as seen in FIG. 1*a*, 4*b*. The conveyer conveys every product to the entry of the feeder where a pushing piston 20 advances the product to the feeding table 26 (FIG. 5) where a slice cut is obtained by slice cutter 4 provided with a slicing blade.

Figure 4A:
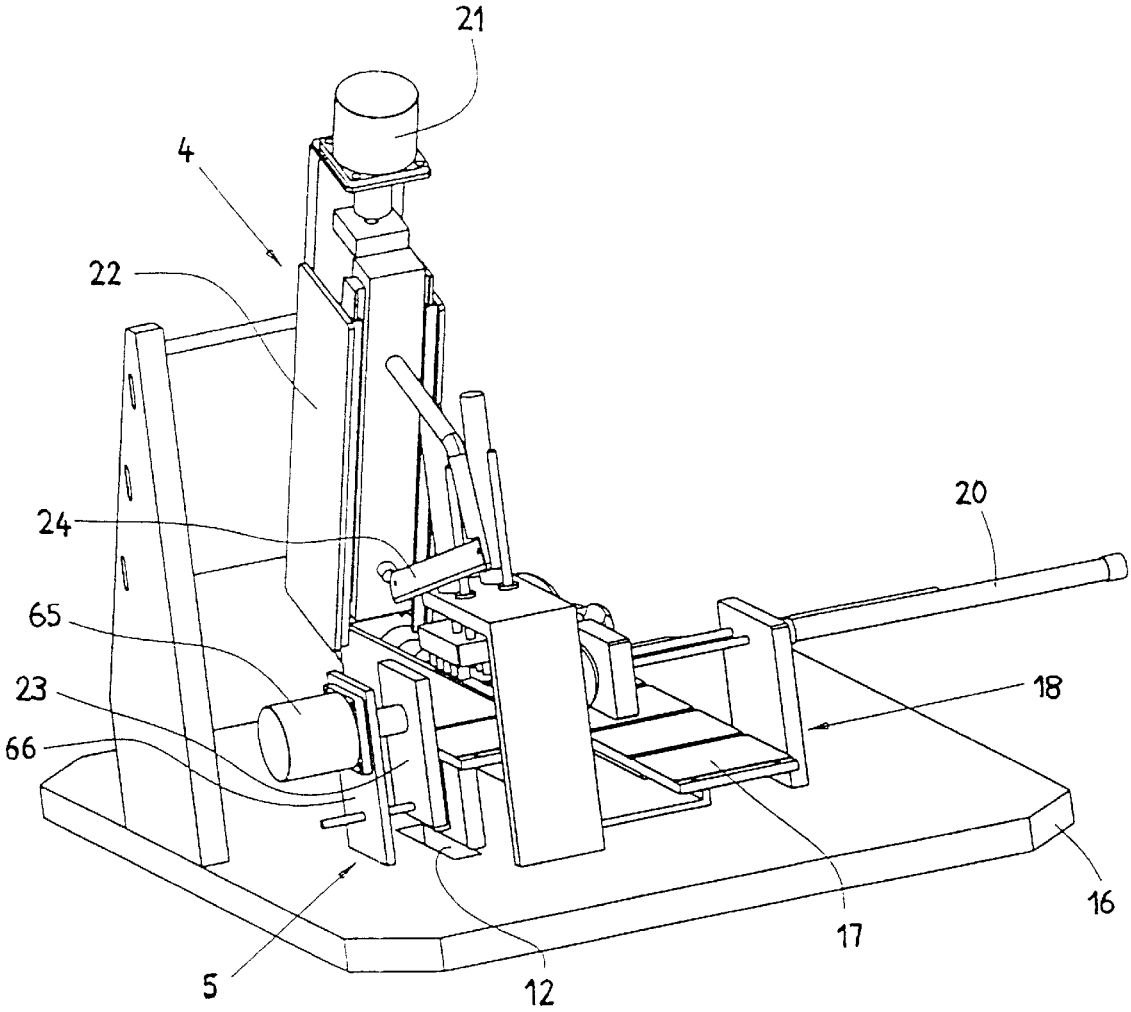
FIG. 4*a* shows a general view of the slicing unit including all its components.
Figure 4B:
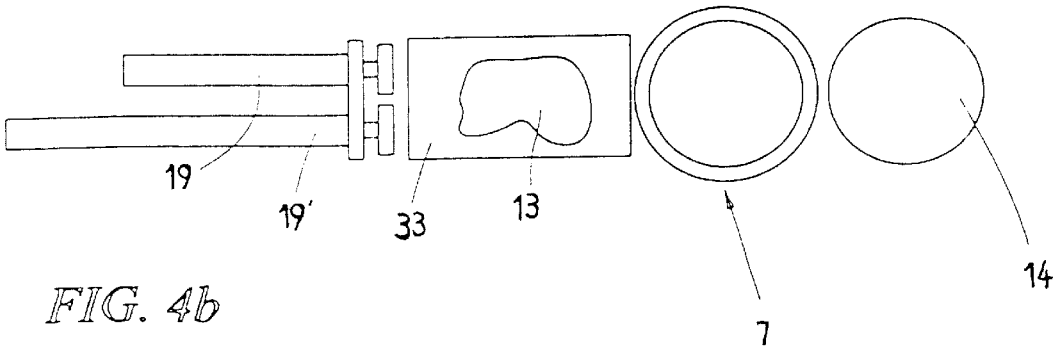
FIG. 4*b* shows a schematic view of the transferring means of a cut slice, refered to the second cutting unit.

The slice cutter comprices a slice cutting device and a dynamic slice width adjuster 5 which defines the width of the sliced cut as seen in FIGS. 1*a*, 4*a*.

The slice cutting device consists of a motor's assembly and a slice cutting blade attached to the motor's assembly through a transmission unit. With respect to FIG. 4*a*, the slice motor's assembly consists of a motor 21 fixed in a housing of the slice cutter 22 and a suitable rotating screw (not shown) which in turn conveys a bracket. A slice cutting blade 24 is mounted on the bracket. The screw is attached to the motor's shaft at one end and to a housing at the opposite end, so converting the rotary movement to linear displacement of the bracket. Placing the blade at an inclined angle relative to the working plane 26 (FIG. 5) causes a cutting action analoque to a human's hand cut, controlled by the computerized means 9. Accelerated penetration into the product and a reversed constant motion of the blade may be obtained through the computerized means in addition to limit switch and performance sensory for controlled activity.

The dynamic slice width adjuster includes a motor's assembly assembled in a bracket and a stopper 23.

Figure 5:
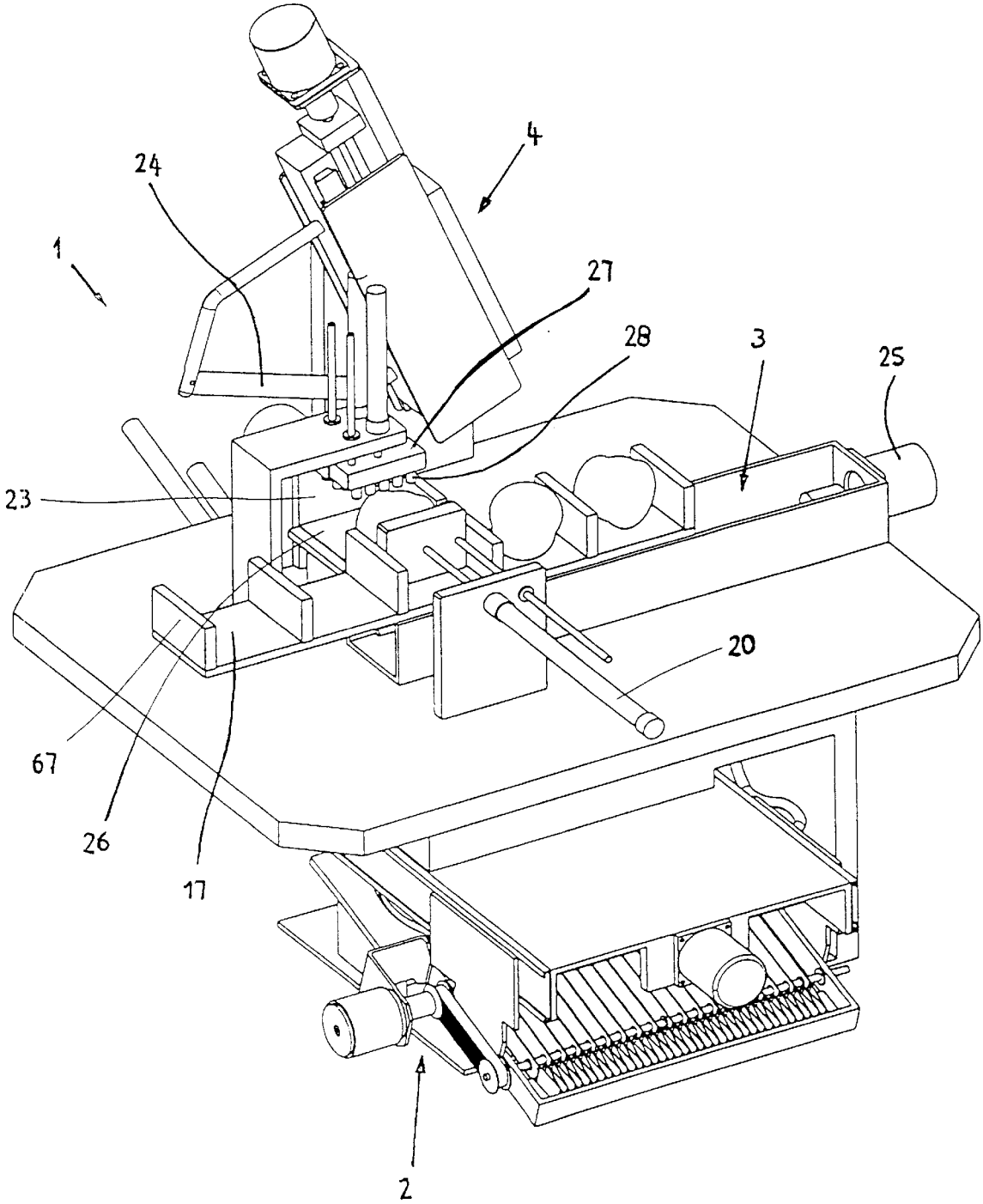
FIG. 5 shows an additional general view of the apparatus.

The motor's assembly includes a motor 65 fixed in a housing 66 and a suitable rotating screw which in turn conveys the stopper 23. The screw (not shown) is attached to the motor's shaft at one end and to the stopper at the opposite end, so converting the rotary movement to linear movement of the stopper. The stopper 23 pushes against the food product, so defining the width of the slice. FIG. 5 shows the cutting blade 24 ready to penetrate the food product hold by fixation means 27 and tauched by a flexible material 28. A side view of the horizontal and vertical cutting unit 2 is seen at the lower part of the FIG. 5.

FIGS. 4, 5 show the entry product conveyer 3 which is operated by a motor 25 provided with a suitable screw, (not shown), for transmitting the rotary movement to a linear displacement of a nut, (not shown), mounted on the conveyer. This arrangement enables conveying of the food products, located in compartments 17, which are ended by a separating wall 67, to feeder's entry for next process step.

The entry product feeder include: a pneumatic pushing piston 20, the feeding table 26 and a fixation means 27.

In order to fix the food product rigidly it is pushed against a dynamic stopper 23 by the the pushing piston 20 during slice cut process. Additional fixations means 27 presses the food product against the feeder's table so as to prevent eventual movement during the slice cut activity. Those fixation means are coated with a coating consisting of a flexible material 28 such as gum to provide stable holding shapeless food product.

Figure 25:
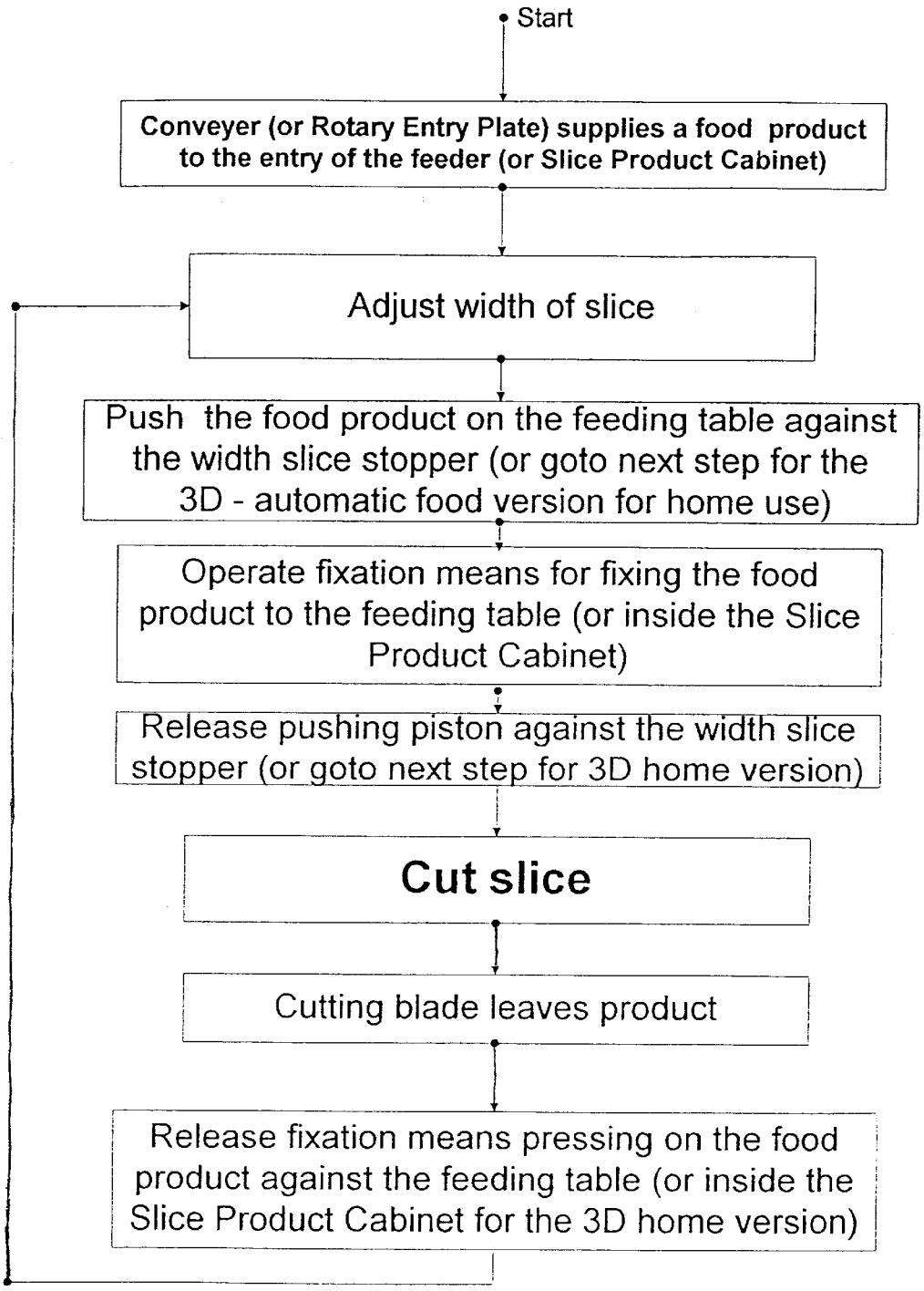
FIG. 25 shows a flow chart describing the slicing of a food product.

FIG. 25 shows a process of slicing the food product using the described fixation means.

The slice cutter works in various modes of operation, defined by the computing device, causing different cutting activities like accelerated penetration of the blade through the cutting process or at an arbitrary invariant velocity, so contributing to a higher cut performance.

The given process enables cutting through different food products or other nonfood materials defined by relative high viscosity. FIG. 4*b* shows a shelf 33, where the dynamic product remover 19, pushes the slice to the working rotary table 7.

Figure 6:
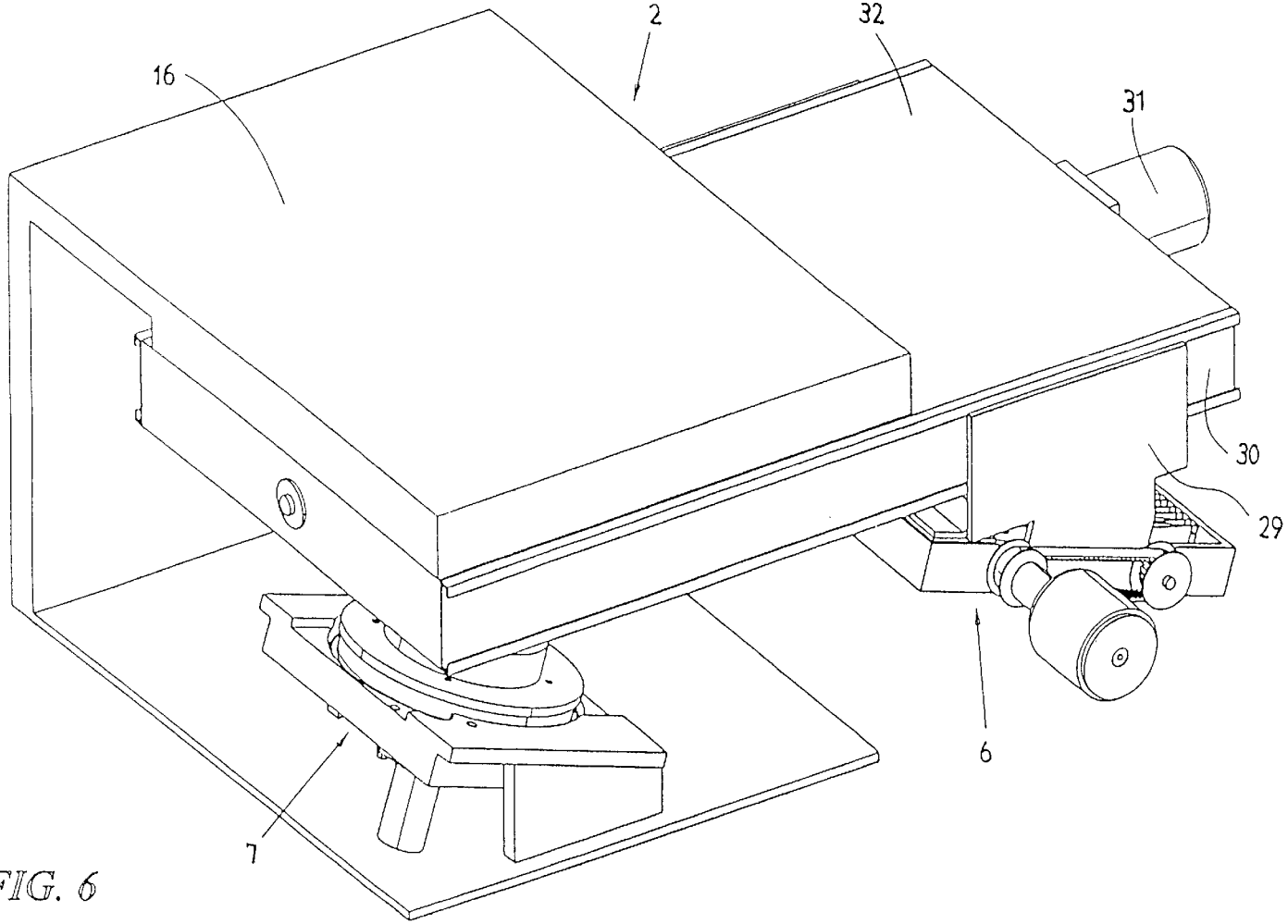
FIG. 6 shows an isometric side view of the horizontal and vertical slice cutter when the cutting head is at the end of the cut process.
Figure 7:
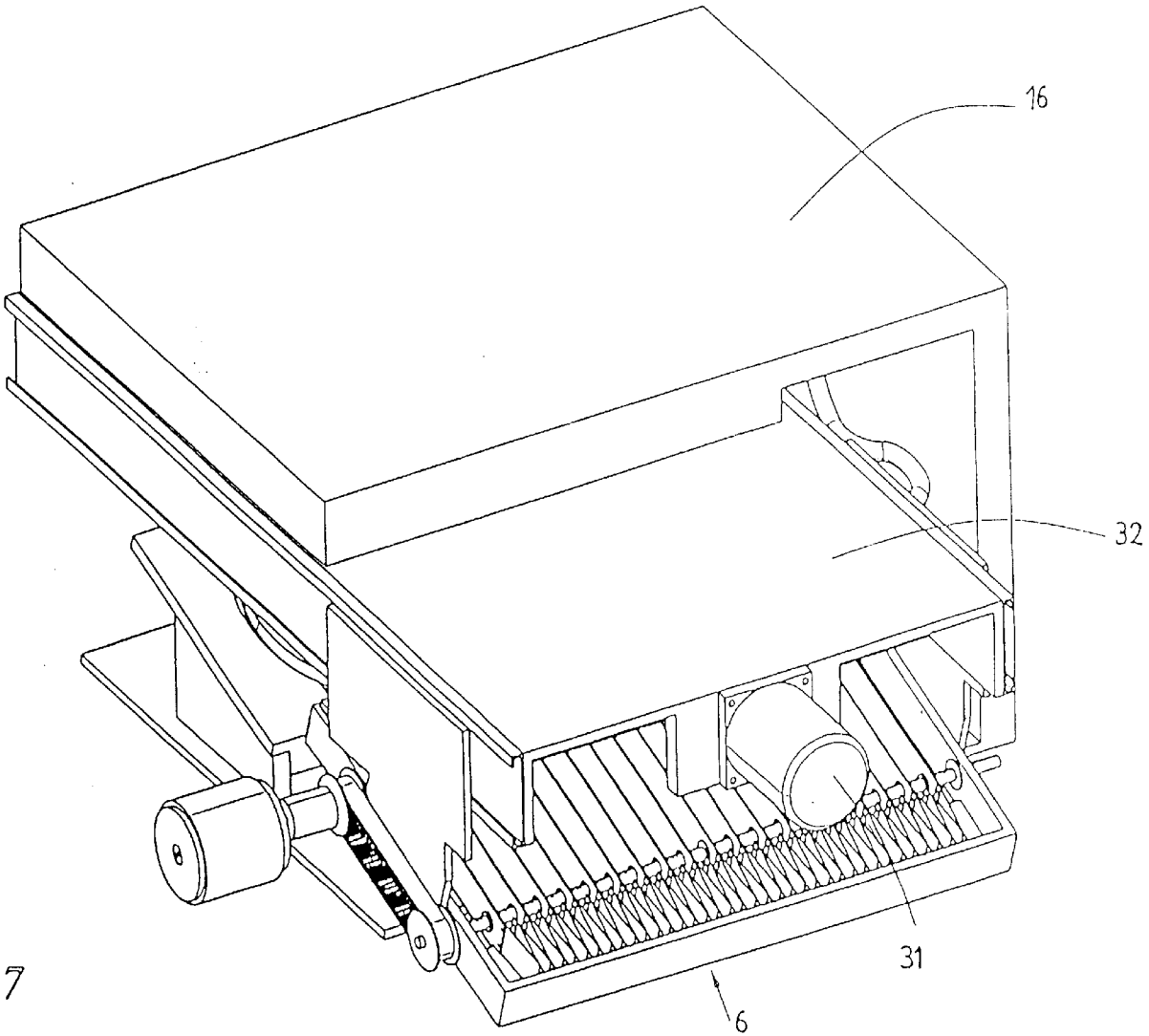
FIG. 7 shows another view of the cutter presented in FIG. 5.

With respect to FIGS. 6, 7, the second cutting unit 2 for horizontal and vertical cutting comprises partially a fixture 32, a housing 16 (which is preferrably common to the cutter unit 1 and unit 2), a rotary working table 7 and a cutting head 6. Slice supply means and cut product storage means are shown in FIG. 4*b*. The fixture 32 serves for holding and conveying the cutting head 6 and consists of a leading screw 35 (seen in FIGS. 8*a,b*) driven by a motor 31 which is attached to the fixture. The screw 35 transforms rotary movement of motor's shaft to linear movement of an adaptor 29 for moving knives holder frame with respect to the rotary working table 7.

The cutting head 6 is keyed to an adaptor 29 moving along 2 parallel slides 30, from opposite sides, so enabling controlled motion of the cutting head as seen in FIG. 6.

Figure 8B:
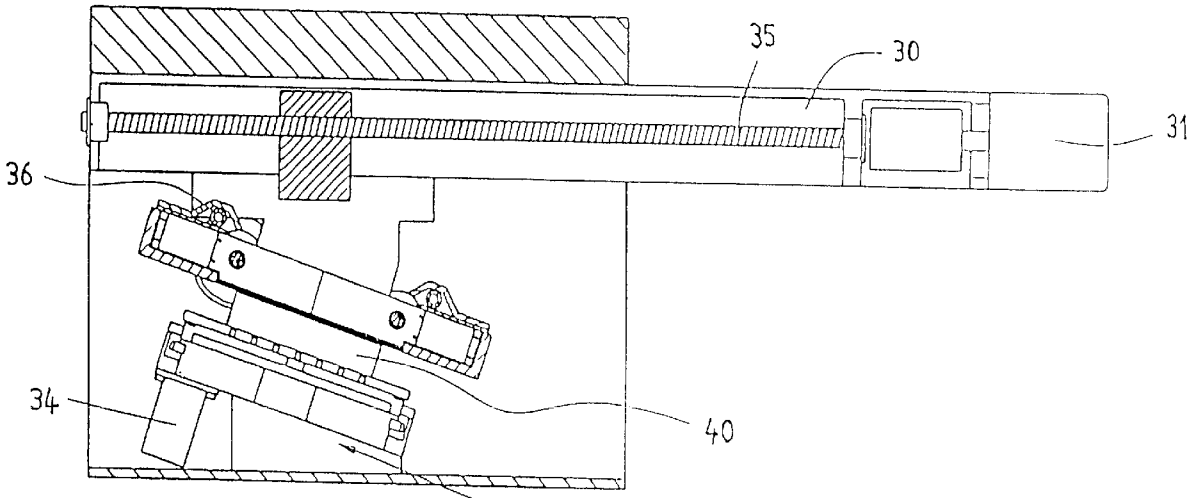
FIGS. 8*a*, 8*b* show a side view of the slice cutter when the cutting head is lifted from the rotary working table and when it approaches it.
Figure 8A:
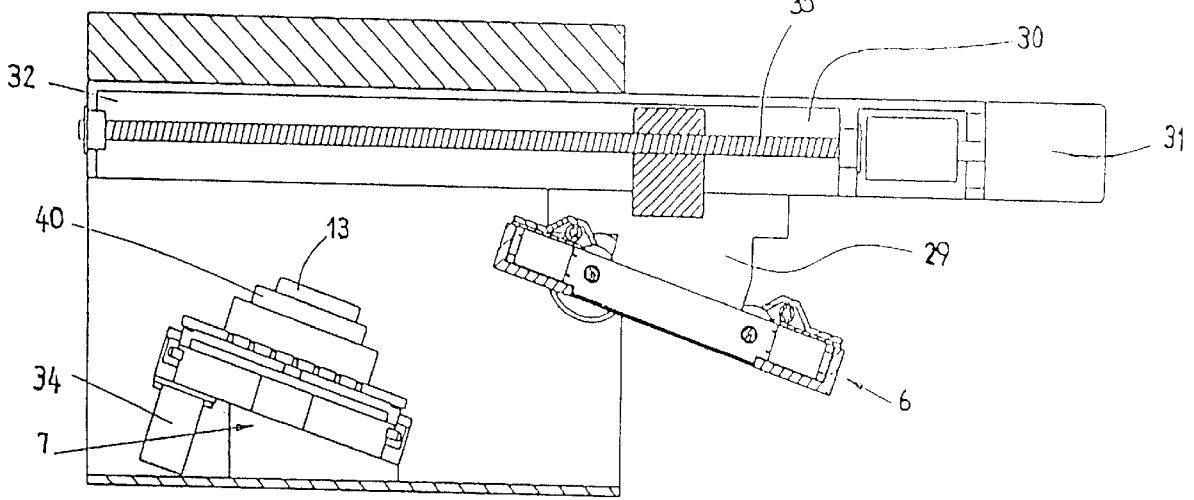

The adaptor 29 for moving the knive's holder frame with respect to the rotary working table 7 moves along an inclined trajectory beginning from a higher point relative to the work table 7 and ending at the working table, as can be seen in FIGS. 8*a*, 8*b*. This motion of the cutting head is similar to a human's hand cutting move. The move of the cutting head shown in FIGS. 8*a*, 8*b* emphasises spatial relationship between the cutting head 6 and the rotary working table 7.

Figure 9B:
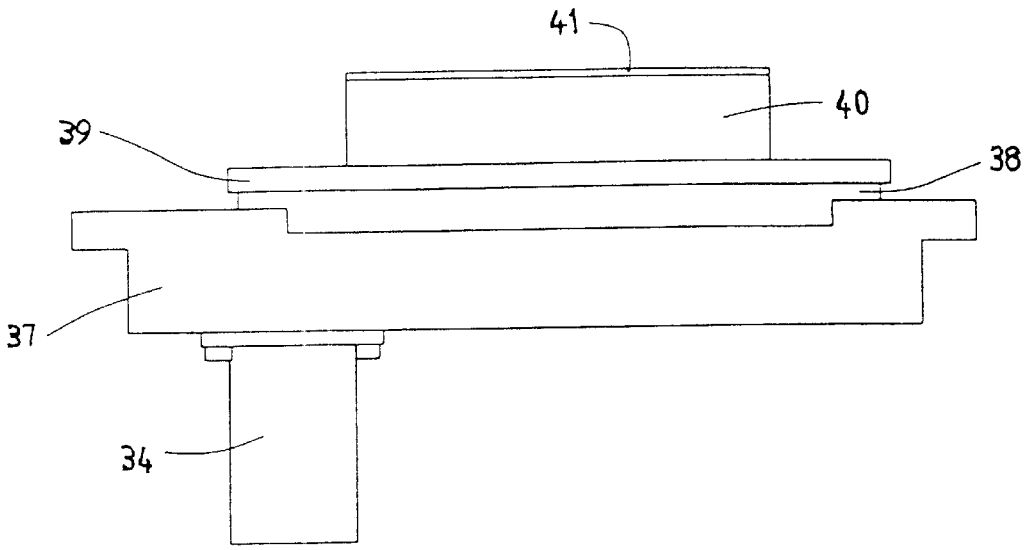
FIG. 9*b* shows a side view of the rotary working table including the table's fixture, different plates and driving motor.
Figure 9A:
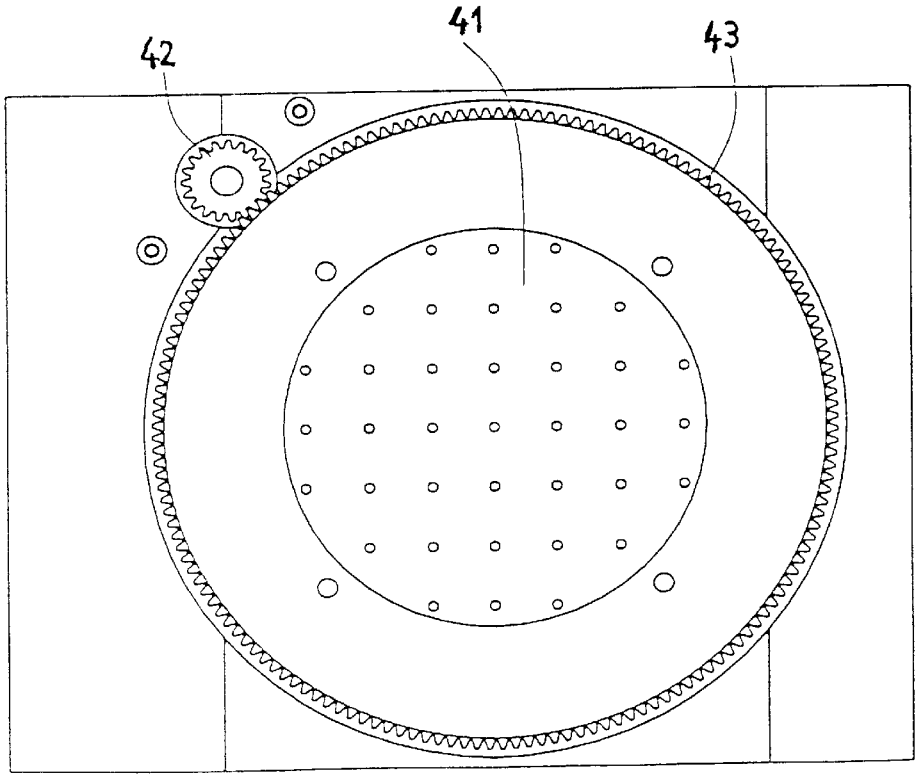
FIG. 9*a* shows an upper view of the rotary working table.

The rotary working table as shown in FIGS. 9*a*, 9*b* consists of a removable cut surface 41, an upper working plate 40, a perforated intermediate plate 39, a lower intermediate plate 38, table's fixture 37, a driving wheel 42, a driven wheel 43, sensory (not shown) and a motor 34. The removable cut surface 41 is replaced after a number of cutting activities. It is preferably made of rough material like teflon, polythylene or polyamide.

Figure 10:
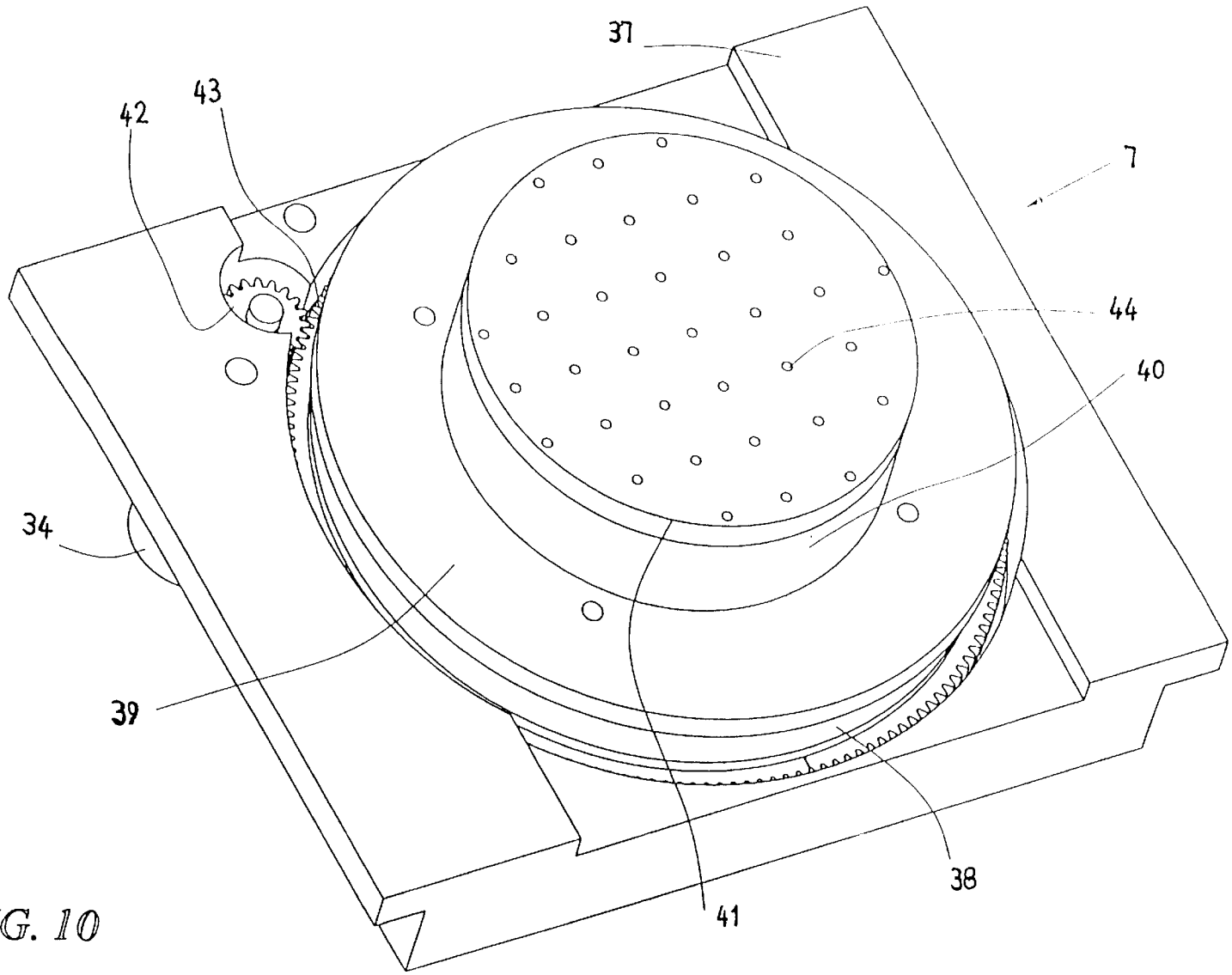
FIG. 10 shows an isometrical view of the rotary working table.

FIG. 10 shows the rough removable cut surface 41 placed on the upper working plate 40 which is keyed to the perforated intermediate plate 39 with perforations for suction of air. The upper working plate 40 is teflon made, and is tightened to the perforated intermediate plate 39. The perforated intermediate plate is a plain surface located upon the intermediate plate 38 which is connected to the fixture table 37. The rotary working table is comprised of a fixture 37 for holding table's components and an attached toothed driven wheel 43 as shown in FIG. 10.

The rotary motion is effected by a motor 34 which rotates the working table.

A driving wheel 42 is attached to the end of motor's shaft for transmitting torque to the toothed driven wheel 43.

The rotary working table motor's torque is transmitted via a toothed driving wheel 42 located on its shaft to the toothed driven wheel 43 for a preprogrammed angle of rotation of the sliced product 13 for changing from horizontal to vertical cut.

For convienence, the given rotary work table is assembled in order to operate as a vacuum table when needed, being connected to a source of vacuum. Air holes 44 are placed in the perforated intermediate plate 39, upper working plate 40 and removable cut surface 41 in order to firmly hold the product on the table for better cutting.

Figure 11:
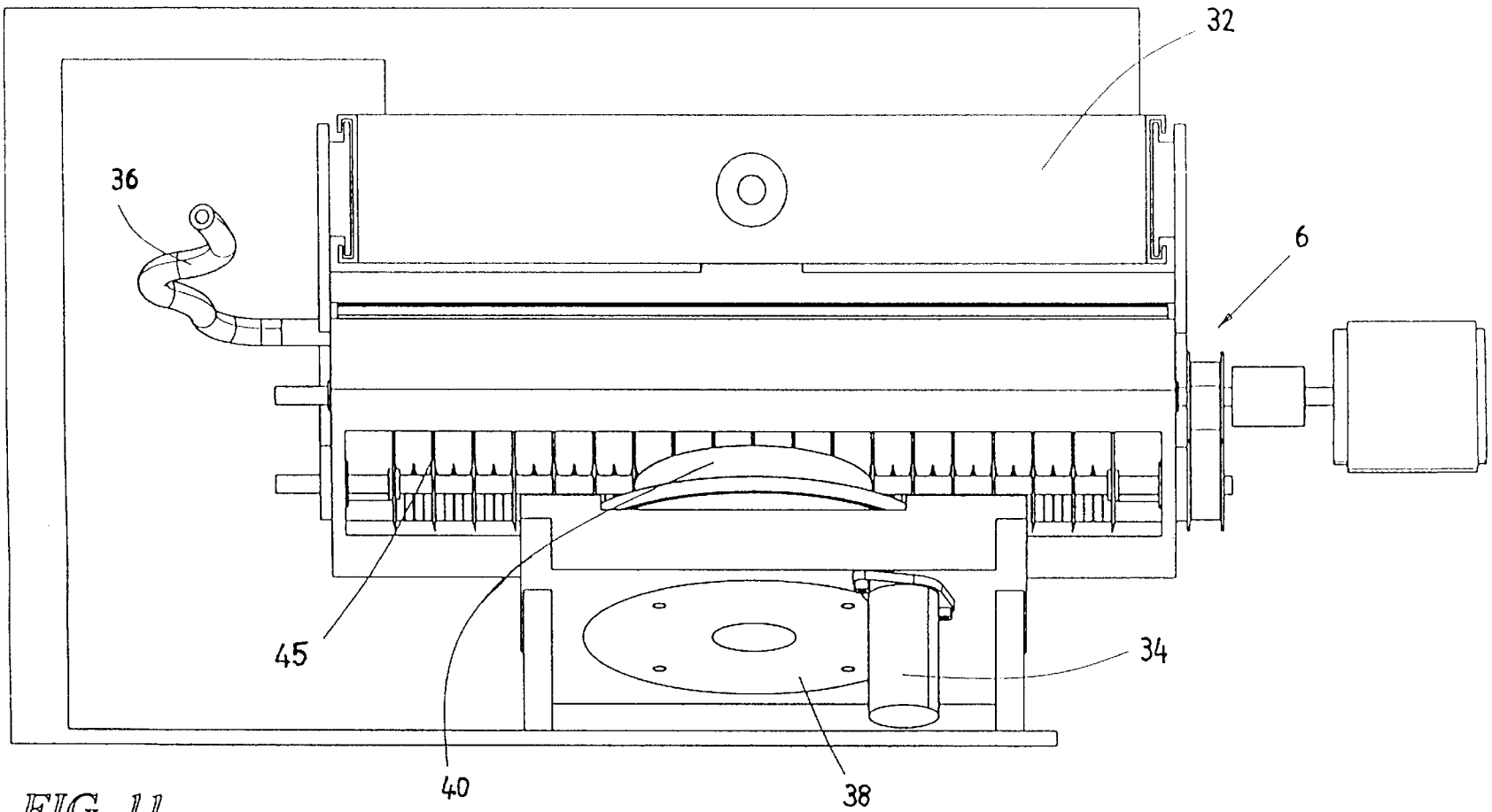
FIG. 11 shows a side view of horizontal and vertical slice cutter including rotary working table, cutting head and holding fixture.

FIG. 11 shows a side view of the rotary working table, the cutting head with the plurality of cutting knives 45 touching the working table together with fixture 32 for holding and conveying the cutting head 6. A source of vacuum is connected to the intermediate plate 38 at its center. The air system is activated for some cutting tasks.

The motor 34 is controlled by the computing device and transmits torque via the toothed transmission means attached to its shaft so rotating the driven table. The motor may turn the table 90 degrees for vertical or horizontal cut and in addition, by virtue of sensory (not shown), cause various product cutting shapes.

Figure 12:
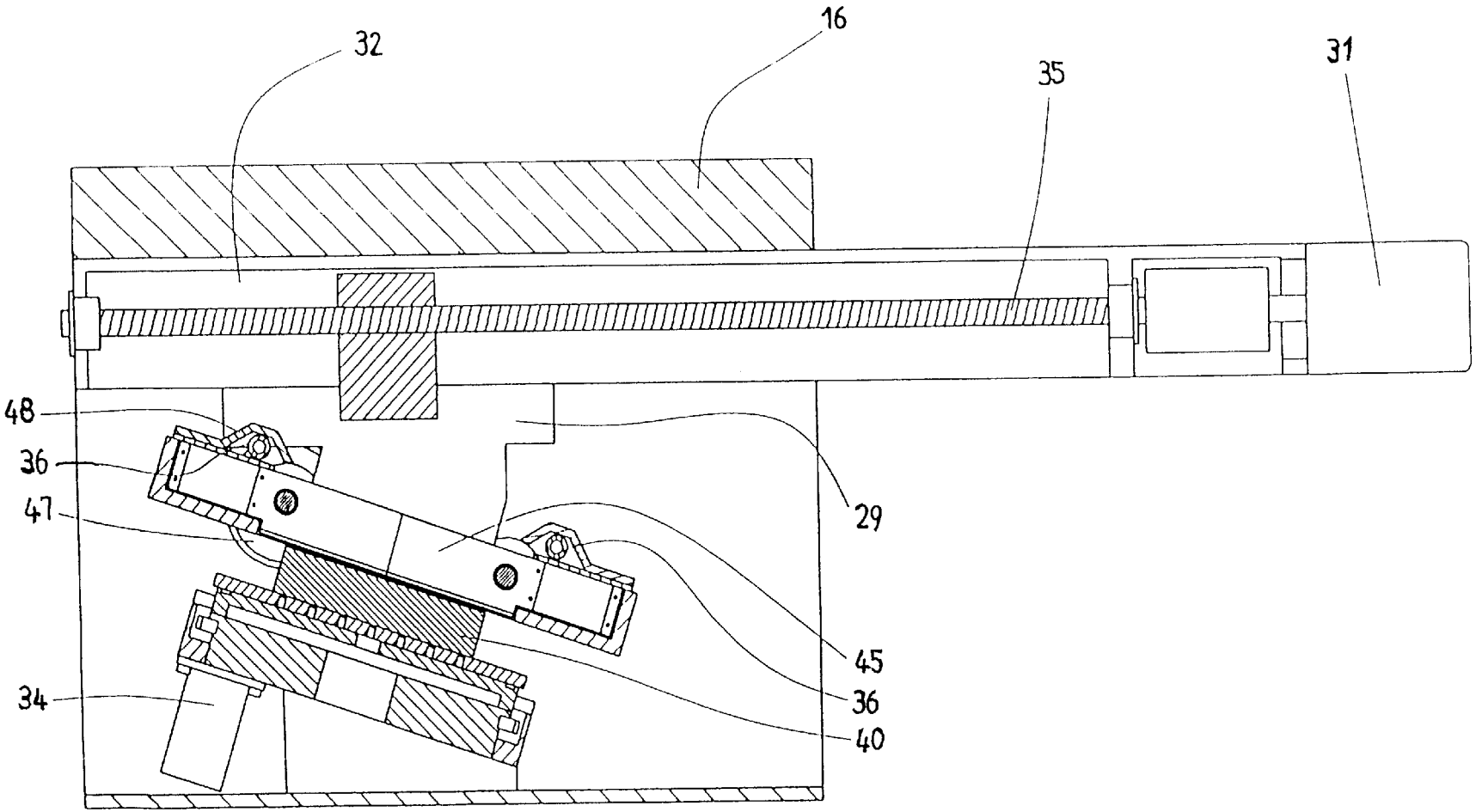
FIG. 12 shows a detailed side view of the cutting head and rotary working table including a means for fixation of the cutting knife during the cutting process.
Figure 13:
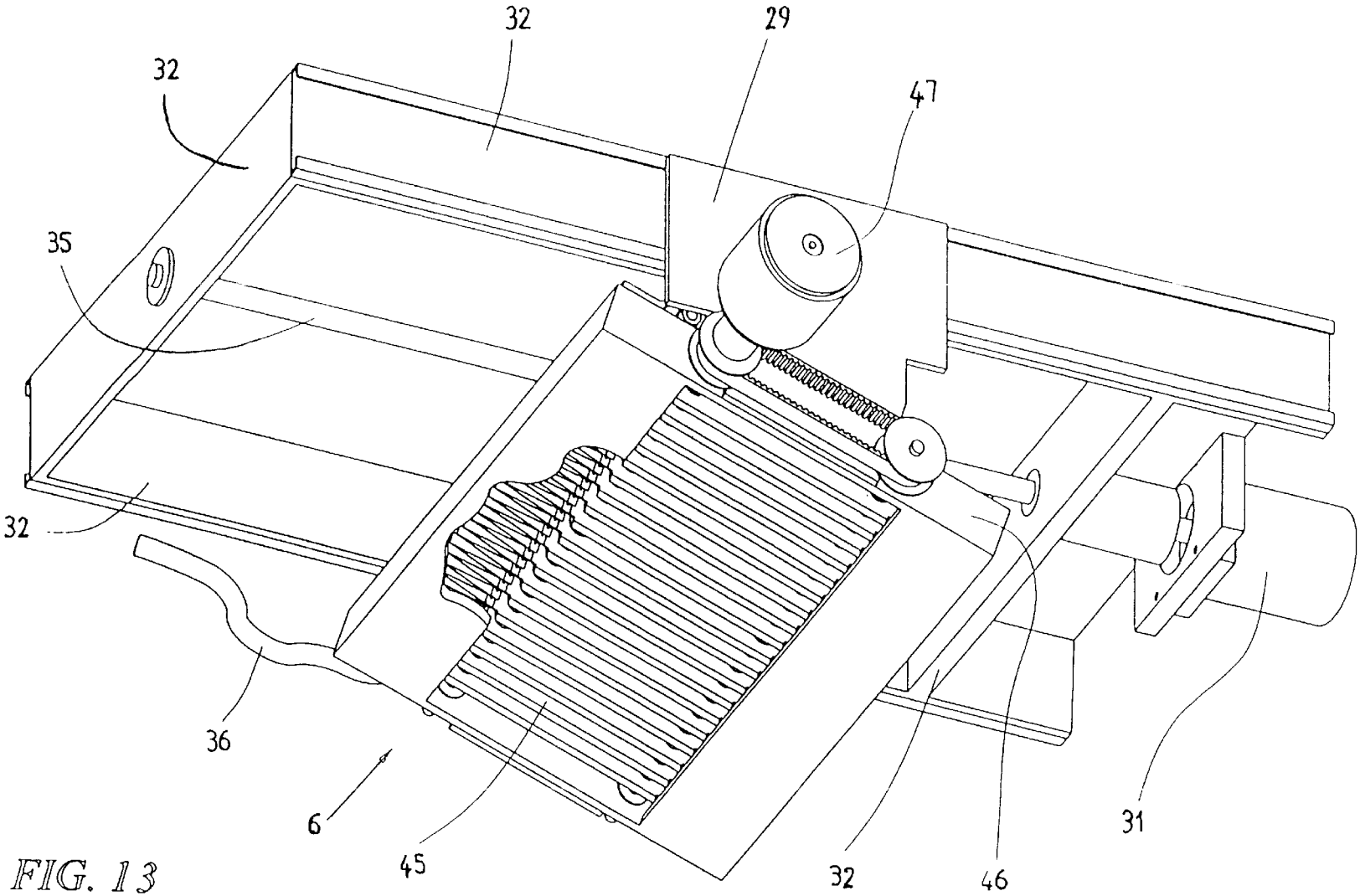
FIG. 13 shows the cutting head attached to a sliding fixture, movable by a motor.

According to an arbitrary rotating angle, varying between 0 and 90 degrees, different shapes of food could be obtained via the computing means. FIG. 12 shows the cutting head approaching the rotary table with the knives 45 located parallel to the table and a tabular element 36 located between a shoulder 48 and the rear part of the knife for fixation of the knife during cut process. Further details will be given later in this section. The cutting head as shown in FIG. 13, comprises a plurality of knives 45 fixed within a base frame 46, cutting head motor 47, transmission means, springs and sensors.

A horizontal and vertical cut process is established via the cutting head 6 that performs a double cut activity, referring to a first cut for a horizontal penetration of the slice, then lifting & leaving the slice for a 90 degrees rotation of the working table (the slice is located on) and then performing a second cut for a vertical cut of slice. Ending the vertical cut stage, leads to a lift & leave the cut product by the cutting head.

The achieved cutting process reduces deformation of the individual pieces of food and provides for homogenous cutting action. Accelerating of cutting speeds increases accuracy of cutting. Fixation of the cutting knives by a pressure of air, adapted through a tabular element, is required prior to the cut process in order to prevent any possible lateral movement of the knives during cutting.

Figure 24:
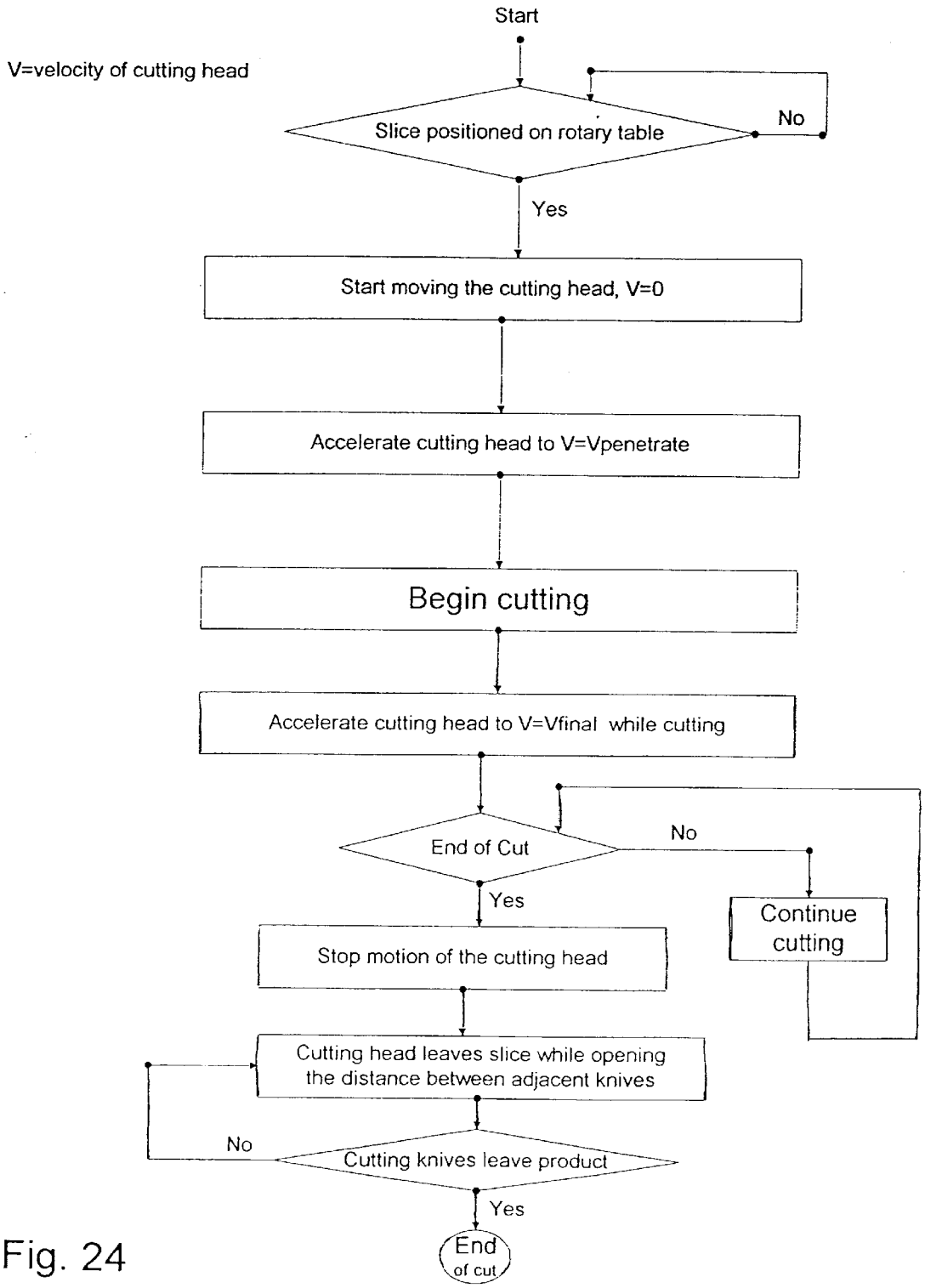
FIG. 24 shows a first or second multicutting process.

With respect to FIG. 24, the cutting head starts moving from rest and is accelerated untill it reaches a penetrate velocity at the slice surface area. The cutting head is then accelerated to a final velocity (while cutting), for a high valued performance. The end of cut is established by a suitable sensor, causing a stop of the cutting head and a start of an opposite movement (leaves the cut product). The distance between adjacent knives is opened during the lifting of the cutting head out of the cut slice for better cut results.

Figure 14:
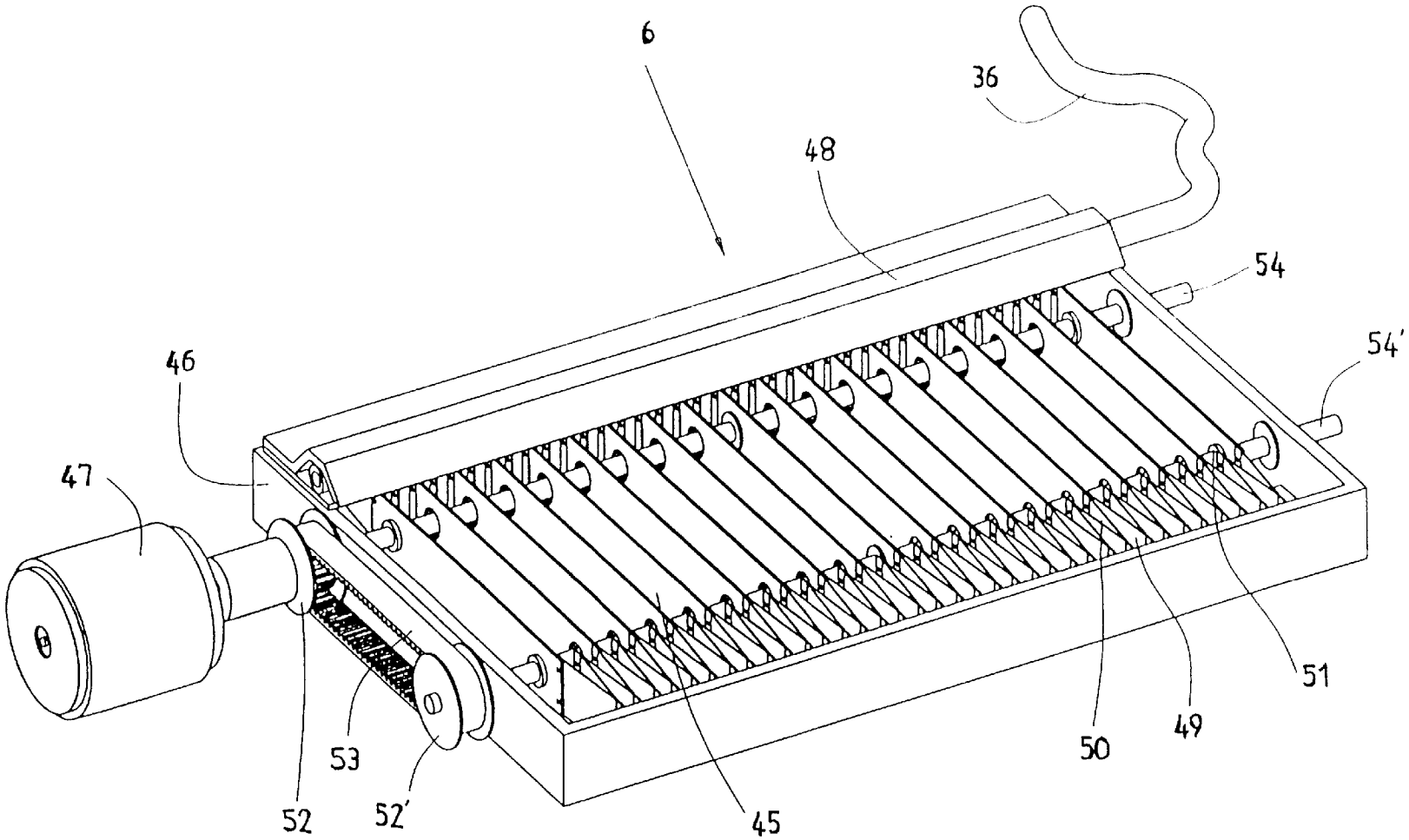
FIG. 14 shows in detail the cutting head including knives, motor and various adjusting and transmission means.

With respect to FIG. 14, a symmetrical construction of the cutting head is obtained by a symmetric rear parts of knives, tabular elements 36 and covering shoulders 48 from opposite sides of the knives. The cutting head motor 47 is connected to a toothed wheel 52 for changing the distance between adjacent knives according the instructions of the computing device. The toothed wheel is connected to the motor at one end and cooperates with a displacement screw 54 at the opposite end for transmitting rotary movement thereto. A transmission belt 53 transmits the torque to a similar toothed wheel 52' so as to rotate displacement screw 54'. Similar covering shoulder 48 and tabular element 36 (not shown), are installed above screw 54'.

Figure 15:
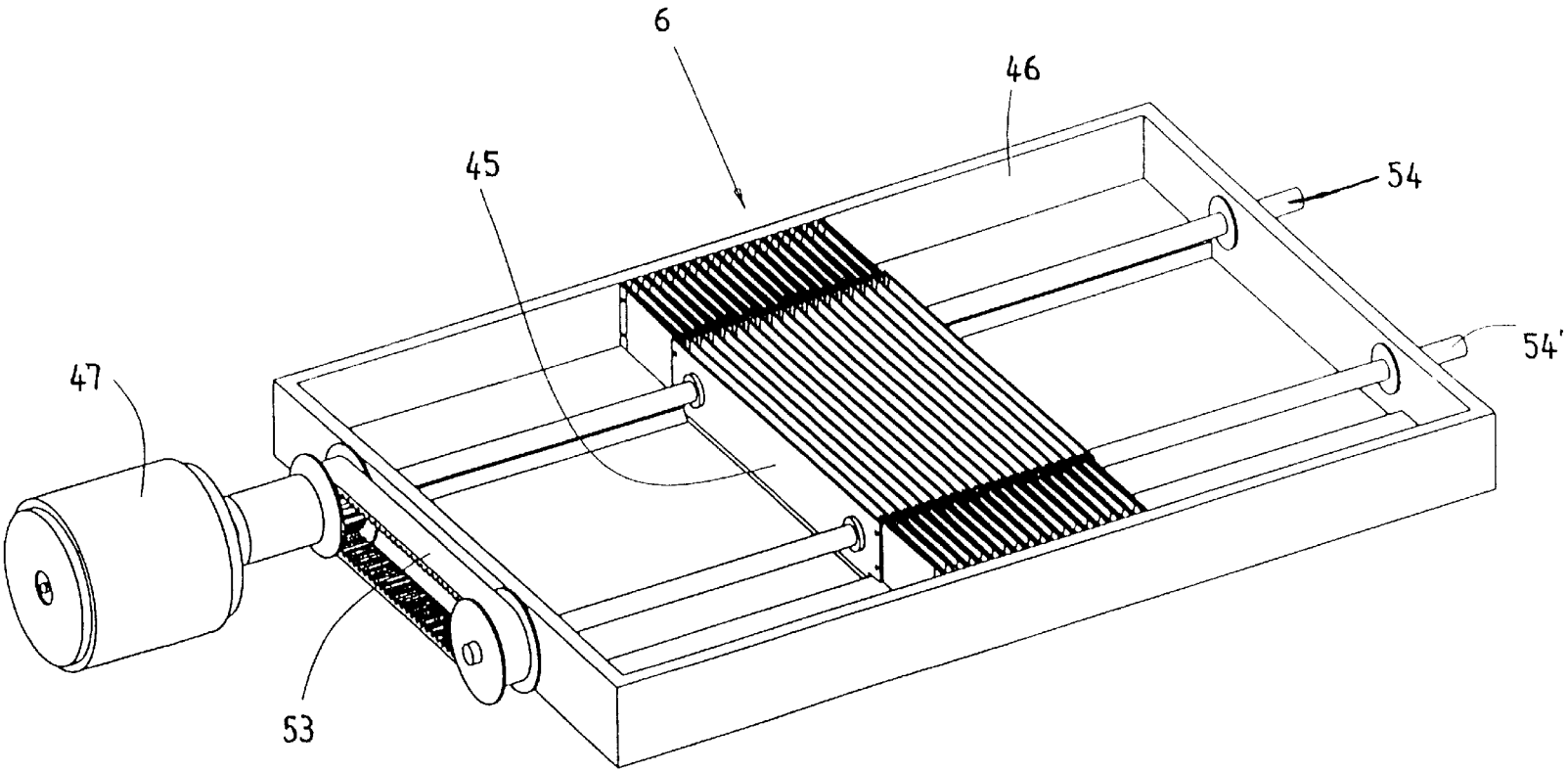
FIG. 15 shows the cutting head when all knives are concatenated at the frame's center, so as to provide for a minimum uniform distance between adjacent knives.

FIG. 15 and FIG. 14 show the set of knives at their compressed position (the knives are concentrated in the center area of the frame) and their distributed position (the knives are distributed through the entire frame) accordingly.

Figure 16:
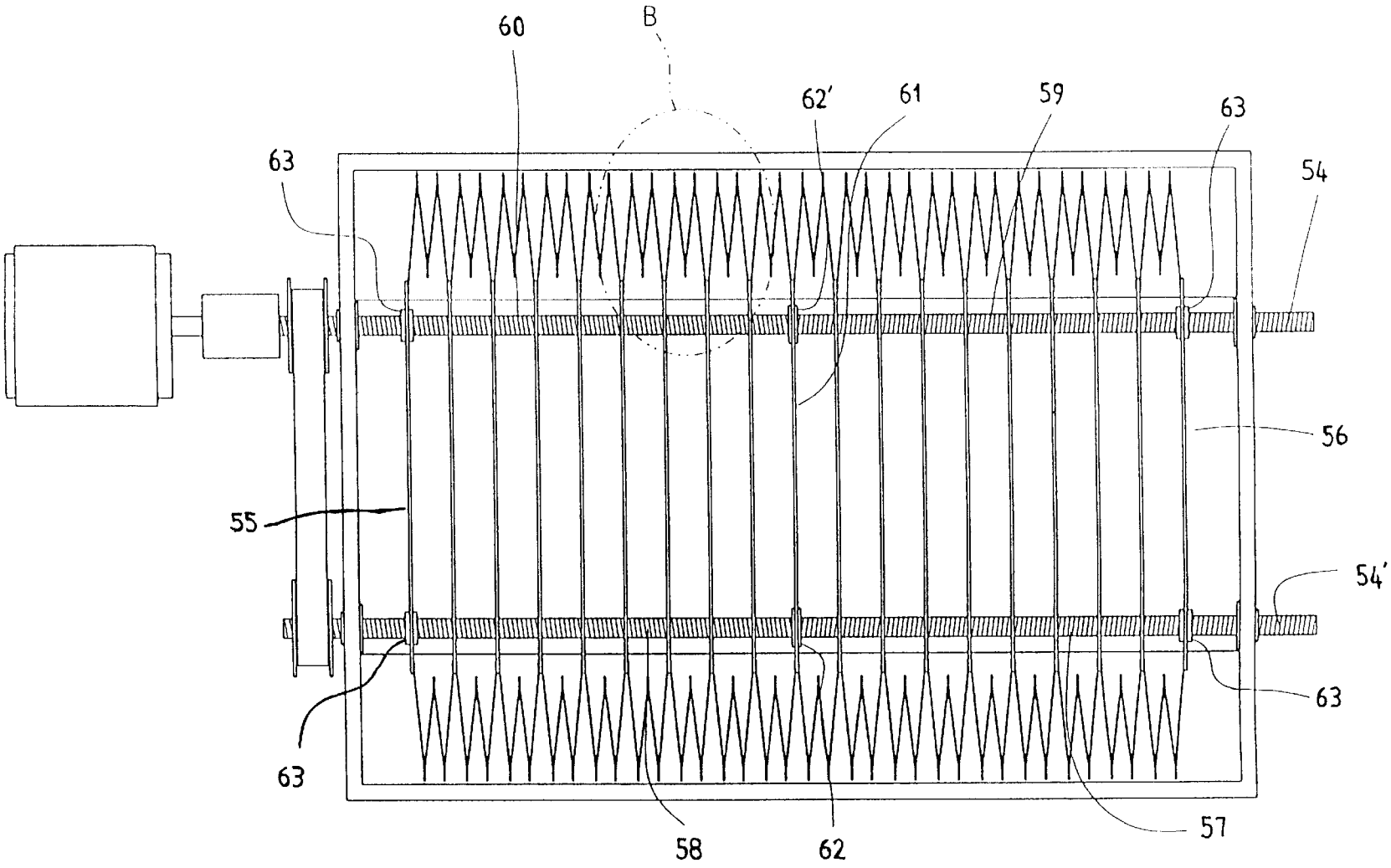
FIG. 16 shows a top view of the cutting head when all knives are distributed in a frame for a maximum uniform distance between adjacent knives.

A cutting knife 45 has holes made at both its opposite ends for mounting on two displacement screws 54,54' and an elongated rear portion at both its ends for connection with a spring leaf. With respect to FIG. 16, a displacement screw consists of a left portion of screw 58 and right portion of screw 57 with correspondingly left-hand threads 60 and right-hand threads 59.

The centered border between the left and right parts of the displacement screw (the origin) is not provided with threads. The right 56 and left 55 outermost knives are made with fixed nuts 63 attached to their corresponding holes, so as to move the knives, rectilinearly upon rotation of displacement screws, relative to the circular displacement of the screws.

Figure 17:
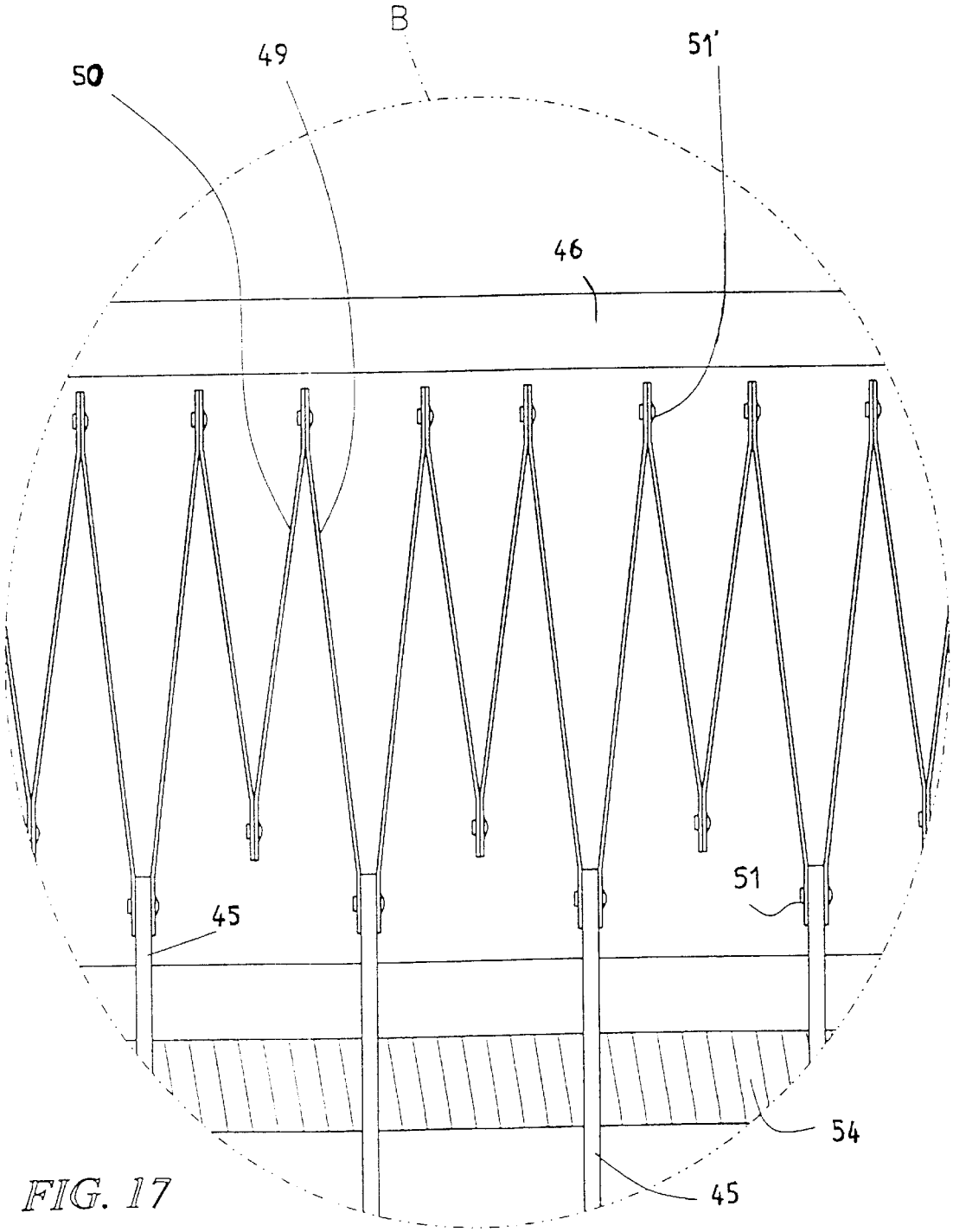
FIG. 17 is an enlarged view of detail B shown in FIG. 16.

The knife residing in the middle of the base frame 61 is fixed by both its oposite ends to the screws via a lock-nuts 62,62' and is always fixed, irrespective to an arbitrary position of the plurality of knives, as time function. The remaining knives are assembled to move freely along the displacement screws depending on the opening of the W-shaped spring, adapted to every knife at its oposite sides, as shown in FIG. 17. FIG. 17 is an enlarged view of detail B, designated in FIG. 16.

The W-spring is connected between any two knives at both sides thereof and is assembled from different types of spring leaf. The W-springs are elastic symmetrical springs, being responsible for transmitting uniform linear displacement of knives.

A long spring leaf 49 is connected to a knife via a connector means 51 and at its opposite end to a short spring leaf 50 via connector means 51'. The connection between the spring leaves or between a spring leaf and a knife is made via connector means such as screws or nuts or by other available means, depending for example, on spring's material. The spring elements can be made of metallic or non metalic material and the particular means for connecting between them will be chosen accordingly.

The distance between the knives is kept uniform by virtue of their symmetric construction and by virtue of the W-springs.

The force of a spring given by $F=-kx$, where F represents force, x the displacement and k an elastic constant, must be identical for all the W springs for symmetric displacement.

According this formula, the elastic constant k should be a common parameter for all the W springs, leading to symmetrical construction & assembly (by materials with suitable characteristics) for symmetrical controlled displacement of the knives.

Figure 18:
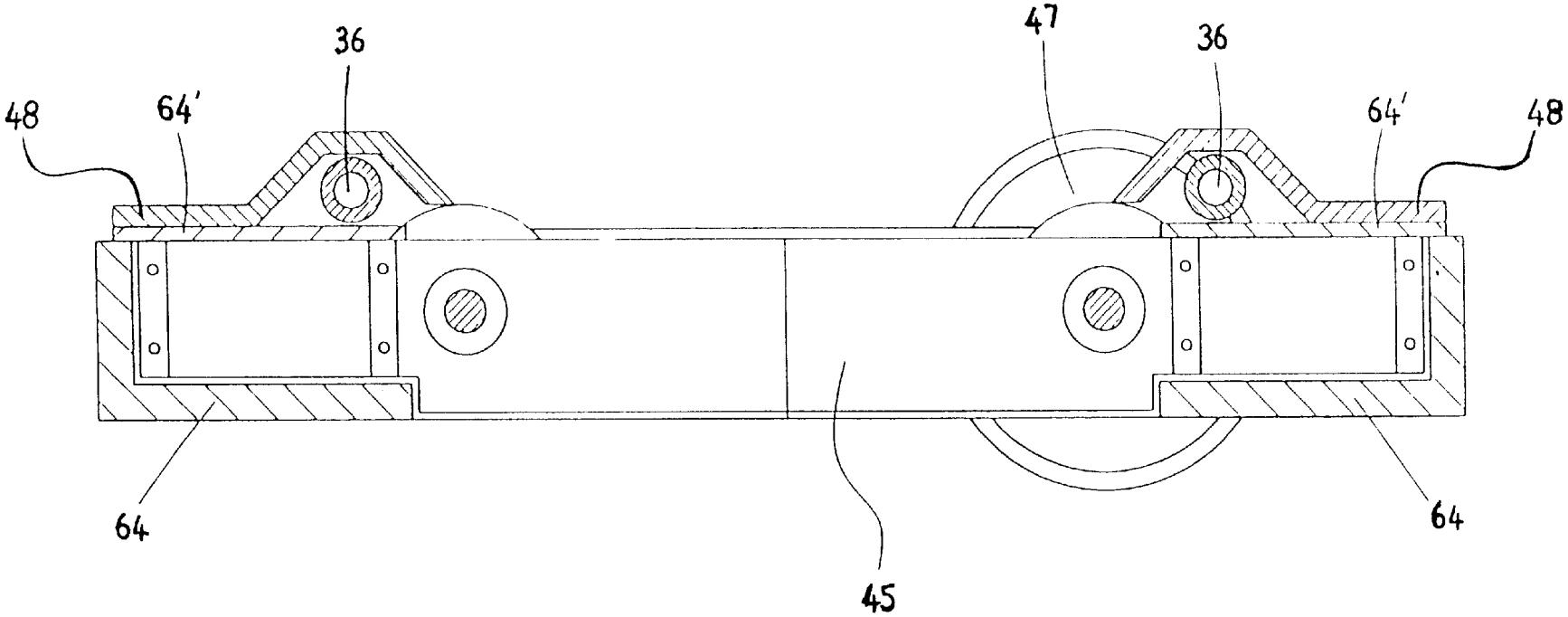
FIG. 18 shows a detailed view of a knife assembeled on the displacement screws.
Figure 19:
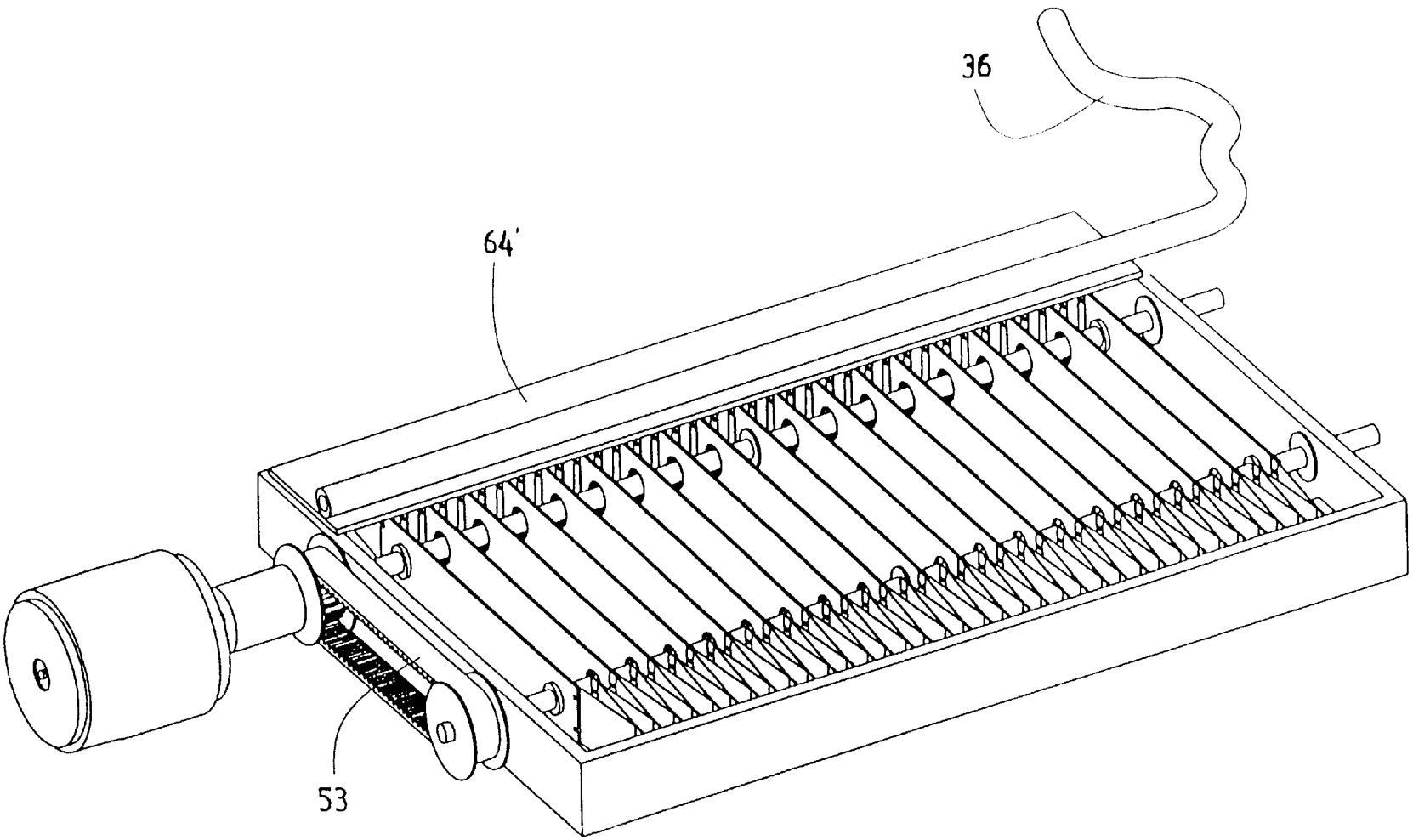
FIG. 19 is an isometric view of the cutting head including the elastic tabular element.

FIGS. 18,19 show an elastic tabular element 36 residing between a shoulder 48 and an upper cover of knives 64' at both sides of the knives. The W springs reside between a lower cover of knives 64, lying on the rear portion of the cutting knives 45 and the upper cover 64'. For cutting of hard products or other materials like some superconductive materials, steady position of the knives is required.

Fixed and steady position of knives when penetrating the product during the cut activity is achieved, for example, by applying a pressure of air through the tabular element, so tighten the working knives without possibility for their lateral movement.

Figure 20:
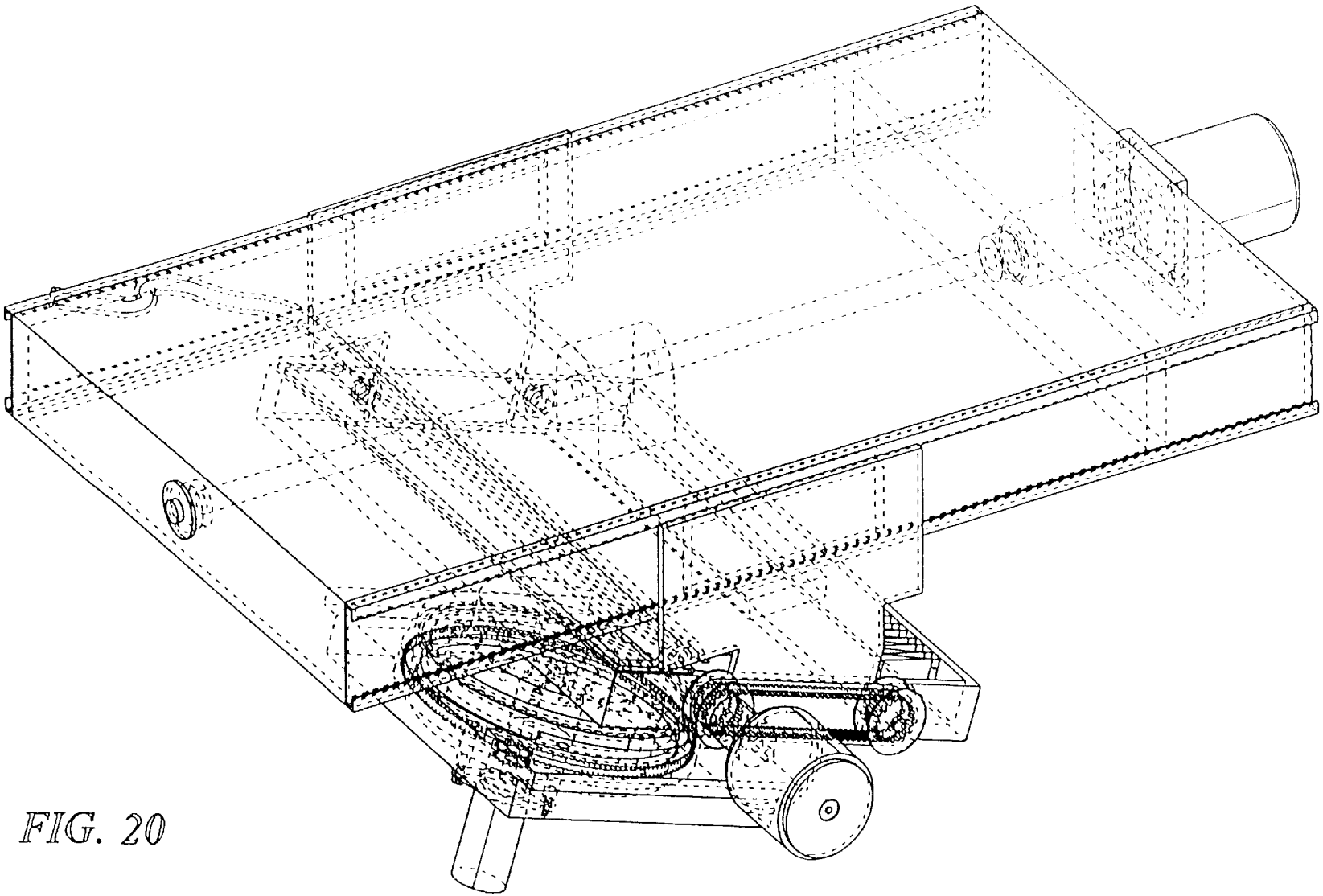
FIG. 20 is an additional isometric view of the processing center including horizontal and vertical cutter system.

The cutting head cuts through the food product until it encounters a stop (not shown) which prevents it from passing through the working table. The horizontal and vertical cut process may be seen in FIG. 20, where the cutting head is shown as driven by a motor attached to the fixture, for a cutting activity upon the rotary working table.

Continuous on-line sensors determine the system's operation and safety separating of cutting operations. As the horizontal and/or vertical cut is completed, a final product remover 19', (FIGS. 1*a*, 4*b*), mounted for lateral motion along a linear path, preferably moves the cut food products from the rotarry work table to the output container 14.

The remover is a pneumatic operated piston as seen in FIG. 4*b*.

In output container mixing and seasoning the food products is optionally established.

The products can be selectively and manually seasoned irrespective of the automatic activities effected in the apparatus, or they can be seasoned automatically—without any human intervention by adding thereto the seasoning center as per my pending patent application IL122104.

Figure 26:
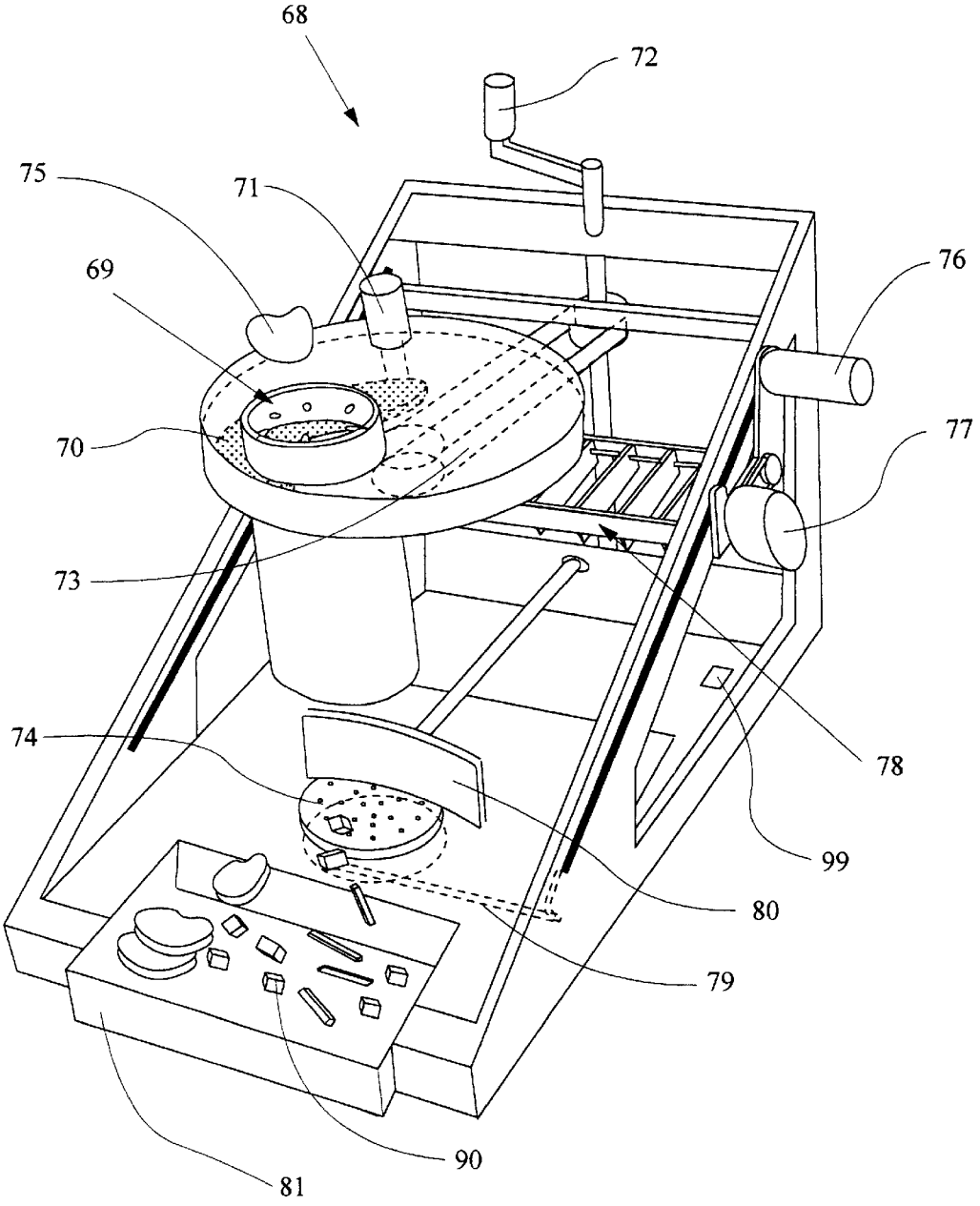
FIG. 26 shows a general view of a semi manually operated, 3D-processing center.

FIG. 26 shows a general view of a semi manual application of the 3D-processing center.

The semi manual 3D cutter 68 consists of a slice cut cabinet 69, a slice cut knife 70, a slice width setup 71, an adjuster for adjusting the distance between knives 77 for horizontal and vertical multicutting, a handle for performing the slice cut 72, a handle for performing the horizontal and vertical multicutting 76, a H&V cutting head 78 for performing the horizontal or vertical cut, a pusher 80 for cut food products 90 which are transferred from the cutting rotary table 74 to the output receiving container 81 and a motorized air pressure system 99.

The semi manually operating process starts by placing a fresh food product 75 into the slice cut cabinet 69, where the product is fixed via the motorized air pressure system 99 and sliced upon rotating the handle 72 which causes the slice cut action via the belt 73. The slice falls on the rotary table 74 where the slice is hold by vacuum and a first multicut is performed by the H&V cutting head 78, operated by the handle 76.

Returning the cutting head back to its initial position, causes a 90 degree movement of the rotary table 74 by virtue of the rotary table belt 79. A second multicut is then performed by the cutting head so obtaining the 3D cut final product. Pushing back the H&V cutting head 78 to half its way, will release the vacum and cause the pusher 80 to swipe the 3D cut product from the rotary table 74 to the output receiving container 81.

Pushing back the cutting head to the second half of its way untill its initial position will cause the pusher 80 to go back to its initial state. The pusher 80 is manually operated when only one multicut is required (chips, etc.) or no multicutting required at all (sliced food products).

Figure 27A:
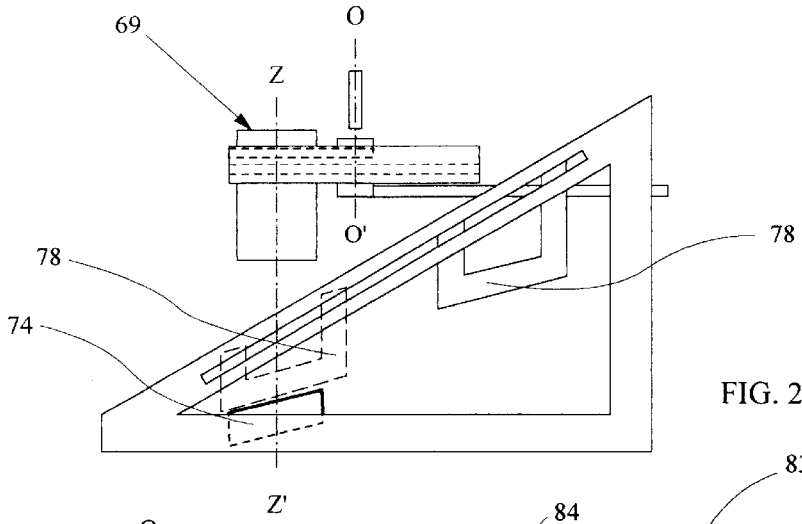
FIG. 27*a* shows a side view of the processing center of FIG. 26
Figure 27B:
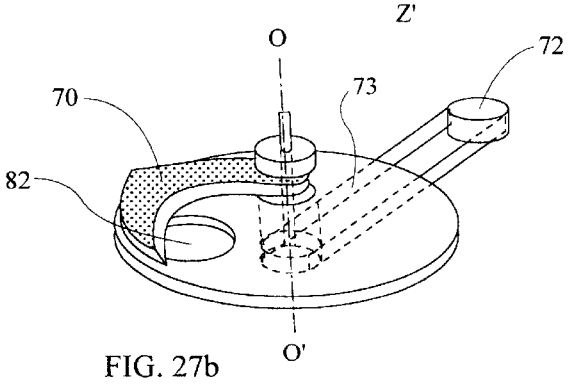
FIG. 27*b* shows an isometric view of the slice cutting knife of the processing center of FIG. 26

FIG. 27*a* shows a side view of the semi manual or automatic version of the 3D-processing center, where the side view including axis zz' shows the operating process from the slice cut cabinet till the working rotary table 74. The oo' axis line is the cutting slice axis as shown in FIG. 27*b*. The schematic motion of the H&V cutting head 78 is shown at its initial position referring to starting of the cut process and at the lower position above the rotary table 74.

FIG. 27*b* shows an isometric view of the slice cutting knife 70 of the semi manual 3D processing center shown in FIG. 26. The belt 73 is operated by handle 72 and causes the slice cut knife to cut the slice which falls through the opening 82 onto the rotary table 74 for the next horizontal and vertical cut.

Figure 27C:
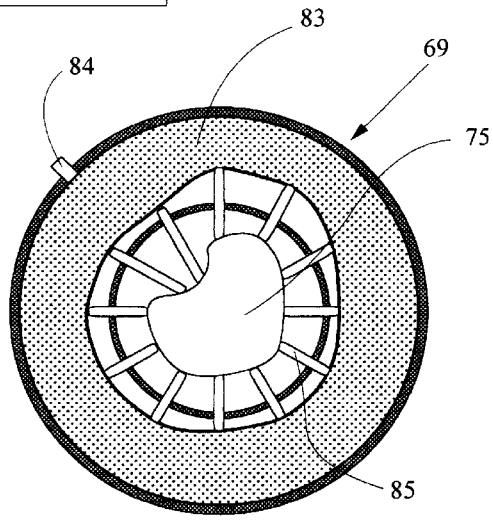
FIG. 27*c* shows an upper view of the slice cut cabinet with a product

FIG. 27*c* shows an upper view of the slice cut cabinet 69 where the fresh food product 75 is held by the flexible fixing element 85 for the slice cut. Air presure 83 enters through the cabinet air inlet 84 and pushes the flexible fixing elements 85 against the fresh food product 75.

Figure 27D:
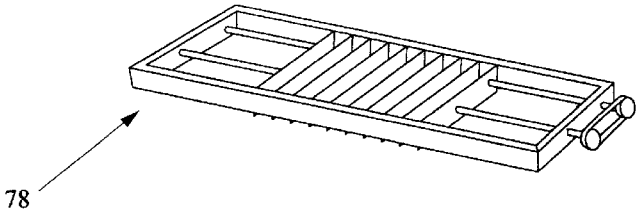
FIG. 27*d* shows an isometric view of the horizontal and vertical cutting head when the knives are spaced at the minimum distance.

FIG. 27*d* shows the cutting head for horizontal or vertical multicutting when the knives are spaced at the minimum distance displacement between the knives.

Figure 27E:
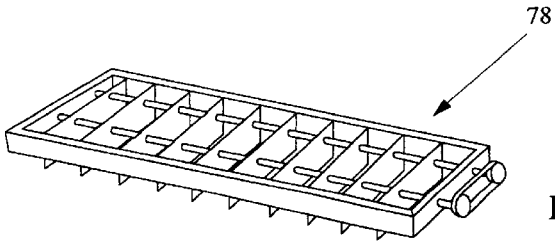
FIG. 27*e* shows an isometric view of the cutting head when the knives are separated at the maximum distance displacement between the knives.

FIG. 27*e* shows the cutting head when the knives are separated at the maximum distance displacement between the knives for obtaining larger pieces.

Figure 28:
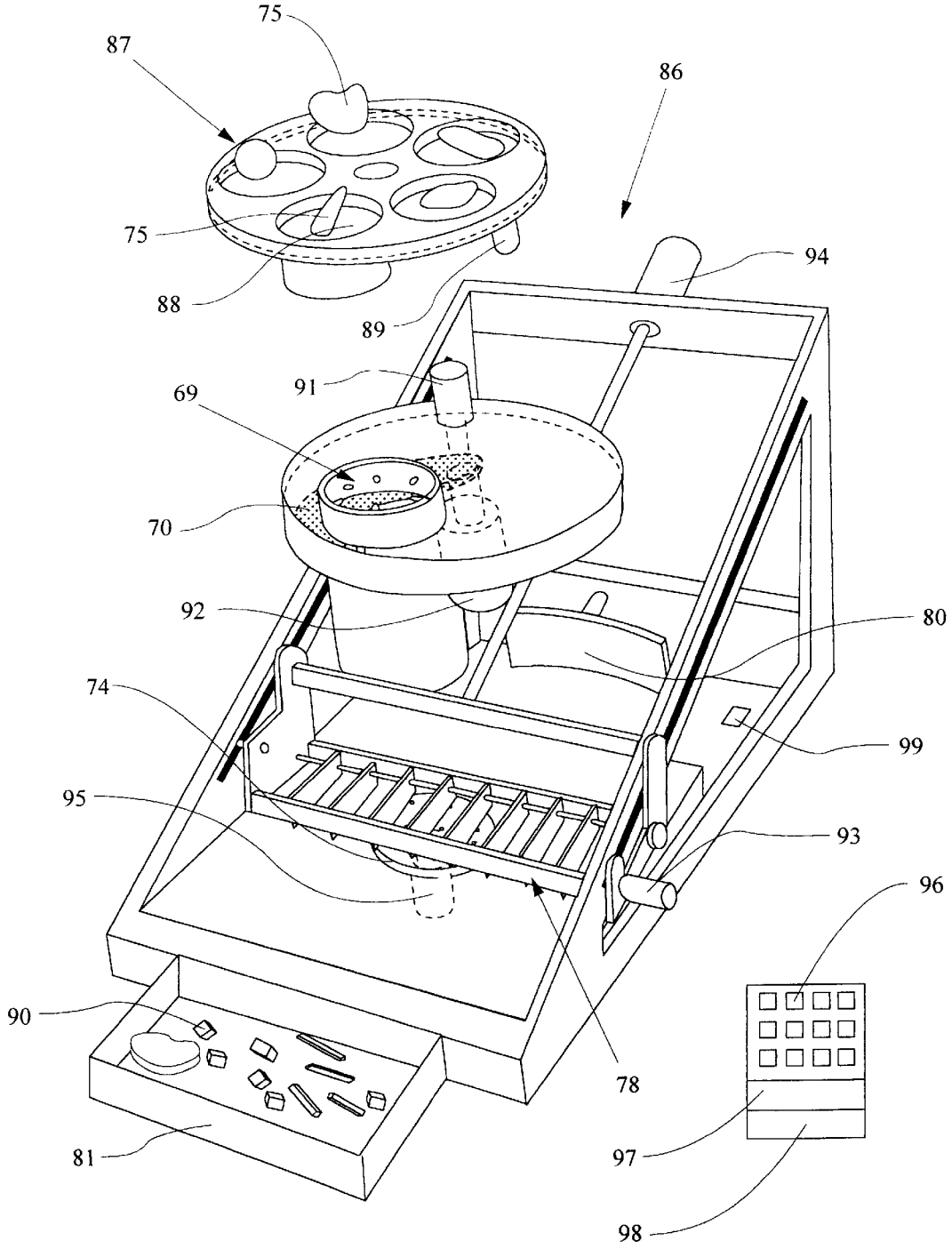
FIG. 28 shows a general view of a completely automatically operated, 3D-processing center for home use.

FIG. 28 shows a general view of a completely automatically operated, 3D-processing center for home use. The processing center consists of a rotary entry plate 87, motor for rotary plate 89, a slice cut cabinet 69, a motor for slice cutting 92, a slice cut knife 70, a motor of slice width setup 91, a rotary table 74, a motor of rotary table 95, a H&V cutting head 78, a distance between knives motor 93, a motor for driving the H&V cutting head 94, a motorized air pressure system 99, a pusher 80, an output receiving container 81, a user programmable interface 96, a computing device 97 and electrically controlled circuits 98.

Different fresh food products 75 are located on the rotary entry plate 87. A start cut program botton is then pressed on the user's interface 96 which causes an automatic cut process ended when all food products are 3d cut in the output receiving container. The apparatus may be manually or automatically operated according to a preprogrammed activity. The width of the slice to be cut is adjusted by the motor of slice width setup 91 and the distance between the knives of the cutting head for vertical or horizontal multicutting is adjusted by the distance between knives motor 93. Those adjustments are performed apriori to the start of the food product cut activity (manually or automatically). The cut process starts with the motor of the rotary plate 89 which rotates the rotary entry plate 87 until a fresh food product 75 falls through the feeding entry 88 into the slice cut cabinet 69 where the food product is held by virtue of the motorized air pressure system 99 (as given in detail in FIG. 27*c*). The fresh food product 75 is then sliced by the slice cut knife 70 opereted by motor of slice cutting 92. The slice falls on to the rotary table 74 where it is fixed by air vacuum produced by the motorized air pressure system 99. A first multicutting is then performed by the cutting head 78 operated by the motor for driving the cutting head 94. When the cutting head 78 leaves the cut slice, the motor of rotary table 95 rotates the slice 90 degrees for a second multicutting performed by the H&V cutting head 78. When the cutting head leaves the cut slice for the second time, the pusher 80 transfers the 3D cut product 90 to the output receiving container 81. Various manual and automatic programs are available through the user programmable interface 96, through the computing device 97 and electrically controlled circuits 98 which operate the various motors and sensors within the apparatus.

LEGEND

1. Entry and slice cutter unit
2. Horizontal and vertical cutting unit
3. Entry product conveyer
4. Slice cutter
5. Slice width adjuster
6. Cutting head
7. Rotary working table

8. Sensor
9. Computing means
10. Control and electronic circuits
11. Operator programmable interface
12. Opening for transferring cut slice to Ver. & Hor. cut part
13. Sliced food product
14. Output container
15. Food product
16. Housing
17. Compartment
18. Feeder
19. Dynamic slice product remover to the rotary table
19' Dynamic cut product remover from rotary table to output container
20. Pushing piston
21. Motor of slice cutter
22. Housing of slice cutter
23. Stopper
24. Slice cutting blade
25. Motor of entry conveyor
26. Feeding table
27. Fixation means
28. Flexible material
29. Adapter for moving knives holder frame with respect to working table
30. Slide
31. Motor for driving the cutting head
32. Fixture holding and conveying cutting head
33. Shelf for pushing the slice to the rotary table
34. Motor of rotary working table
35. Leading screw
36. Elastic tabular element
37. Table fixture
38. Intermediate plate
39. Perforated intermediate plate with perforations for suction of air
40. Upper working plate
41. Removable cut surface
42. Driving wheel
43. Driven wheel
44. Air holes
45. Cutting knives
46. Knives base frame
47. Cutting head motor
48. Shoulder
49. Long spring leaf
50. Short spring leaf
51, 51' Leaf spring connection
52, 52' Toothed wheel
53. Transmission belt
54, 54' Displacement screw
55. Left outermost knife
56. Right outermost knife
57. Right portion of screw
58. Left portion of screw
59. Right hand thread
60. Left hand thread
61. Center knife
62, 62' Lock nut
63. Nut
64. Lower cover of knives
64' Upper cover of knives
65. Motor of slice width adjuster
66. Adjuster housing
67. Separating wall
68. Semi Manual 3D-Cutter
69. Slice cut cabinet
70. Slice cut knife
71. Slice width setup
72. Handle for slice cut
73. Belt
74. Rotary table
75. Fresh food product
76. Handle for horizontal and vertical cut
77. Distance between knives adjuster
78. H&V cutting head
79. Rotary table belt
80. Pusher
81. Output container
82. Opening
83. Air pressure
84. Cabinet air inlet
85. Flexible fixing element
86. Automatic 3D-processing center
87. Rotary entry plate
88. Feeding entry
89. Motor for rotary plate
90. 3D-cut products
91. Motor for slice width setup
92. Motor for slice cutting
93. Distance between knives motor
94. Motor for driving the H&V cutting head
95. Motor of rotary table
96. User programmable interface
97. Computing device
98. Electronically controlled circuits
99. Motorized air pressure system

What is claimed is:

1. An apparatus fox cutting an integral piece of a fruit or vegetable into smaller separate pieces, said apparatus comprising:

a first cutting unit capable of preliminary slicing the integral piece into sliced sections, said unit being provided with (a) a working area into which the integral piece is fed (b) a holding means for stationary holding the integral piece within the working area (c) a first cutting unit provided with a slicing means capable to slice the integral piece into sliced sections, (d) a first driving means capable to impart motion to the slicing means, said motion is accompanied by slicing of the integral pieces into sliced sections, a means for discharging the sliced sections from the working area and for directing them to a second cutting unit capable to effect a cutting action to cut the sliced sections into a plurality of smaller pieces, said cutting unit being provided with a working table adapted to receive the sliced sections discharged from the first cutting unit, said table being rotatable and indexable so as to expose said sections successively to a cutting action along at least two non parallel cutting directions, a second cutting unit for effecting said cutting action, said second cutting unit having a plurality of parallel cutting knives residing within a base frame, said base frame being mounted above and parallel to said working table in a manner that allows said cutting knives to approach the sliced sections at an inclined angle and to effect the cutting action along a cutting direction, a second driving means capable to impart to the base frame linear reciprocating motion accompanied by multiple cutting action of said sliced sections effected by the plurality of said knives, a fixing means for holding the sliced pieces on said working table during said cutting action along said at least two non parallel cutting directions, a control means for automated operation of the apparatus.

2. The apparatus as defined in claim 1, in which said first cutting unit comprises a means for adjusting the width of sliced section and said second cutting unit comprises a pushing rod adapted to evacuate the smaller pieces from the working table.

3. The apparatus as defined in claim 1, in which said first cutting unit resides above the said second cutting unit.

4. The apparatus as defined in claim 1, wherein said fixing means for holding the sliced pieces includes a plurality of perforations within said working table, said perforations being connected with a source of vacuum.

5. The apparatus as defined in claim 1, in which said second cutting unit is provided with a means for variation of the distance between the planes of adjacent knives.

6. The apparatus as defined in claim 5, in which said means for variation of the distance between the planes of adjacent knives comprises a first and a second parallel rods, said rods being mounted in said base frame with possibility for rotation, each of said rods being provided with a screw, the direction of the screw along the half length of the rod is opposite to the direction along the other half length of the rod, and said knives are displaceable along said rods.

7. The apparatus as defined in claim 6, in which a knife residing in the middle of said base frame is steady fixed thereon, wherein the other knives are divided into two identical groups, the first group is disposed on the right side with respect to the middle of said base frame and the second group being symmetrically disposed on the left side with respect to the middle of said frame, said groups being displaceable along said rods in mutually opposite directions.

8. The apparatus as defined in claims 6, in which said second cutting unit is provided with a means for rotation of at least one of said screwed rods and the knives which are remote from the middle of said base frame are provided with a first and second nut means cooperating correspondingly with the first and second screwed rod, said nut means is capable to convert rotational motion of the rods into linear displacement of the knives, wherein the opposite rear portions of all adjacent knives are connected therebetween by a spring elements capable to transfer the linear displacement of the knives which are remote from the middle of said frame to the rest of knives, said elements being identical in shape and having identical elastic properties so as to enable symmetrical and controllable displacement of the knives.

9. The apparatus as defined in claim 8, in which said spring elements comprise flat springs arranged in a W-shaped fashion.

10. The apparatus as defined in claim 9, in which said base frame is provided with a fixation means for fixation the distance between the planes of adjacent knives, said fixation means comprising an inflatable tubular element connected with a source of pressure.

11. The apparatus as defined in claim 1, in which said first driving means comprises manually rotatable handle suitable for imparting rotating motion to the slicing means.

12. The apparatus as defined in claim 11, in which said second cutting unit is mounted with possibility for advancing to and retracting from the working table, said retracting is accompanied by rotating and indexing of the working table in a working position.

13. The apparatus as defined in claim 11, in which said first driving means comprises a motor, said first cutting unit is provided with a rotary entry plate adapted to receive the integral pieces to be sliced and to bring them successively to the working area, and said apparatus is provided with control means for its programmed operation.

14. The apparatus as defined in claim 1, in which the first cutting unit is provided with (a) a transporting means adapted to advance the piece to be cut towards the working area, and, (b) a feeding means adapted to advance the piece within the working area, said slicing means is formed as a slicing blade connectable to a frame, said blade is slanted with respect to the plane of the working area, wherein said first driving means is capable to impart linear reciprocating motion to said slicing blade to approach the integral piece and to slice thereof into separate sections, said first driving means is capable to accelerate the said motion after the integral piece is approached, the apparatus further comprising (c) a third driving means capable to rotate said working table and to index thereof in the working position.

15. The apparatus as defined in claim 14, in which said transporting means comprises a conveyer with secured thereon plurality of compartments adapted to receive therein integral pieces to be sliced, said conveyer being driven by a motor.

16. A method for cutting an integral piece of a fruit or vegetable into smaller separate pieces, said method comprising:

(a) placing the integral piece within a first working area (b) fixation of the integral piece steadily within the first working area (c) slicing the integral piece into sliced sections by a slicing means (d) discharging the sliced sections from the first working area (e) directing the sliced section to a second working area so as to expose them to a cutting action performed by a plurality of parallel cutting knives (f) adjusting a distance between the planes of adjacent cutting knives according to desired width of the finally cut smaller pieces (g) cutting the sliced sections into smaller pieces along a first cutting direction by a plurality of parallel cutting knives effecting simultaneous multiple cutting action along a first cutting direction (h) indexing the second working area in a position in which the sliced sections are exposed to multiple cutting action along a second cutting direction, said second cutting direction being non-parallel to the first cutting direction (i) cutting the sliced sections into smaller pieces along a second cutting direction by the plurality of parallel cutting knives.

17. An apparatus for cutting an integral piece of a fruit or vegetable into smaller separate pieces, said apparatus comprising:

a first cutting unit capable of preliminary slicing the integral piece into sliced sections, said unit being provided with (a) a working area into which the integral piece is fed (b) a holding means for stationary holding the integral piece within the working area (c) a first cutting unit provided with a slicing means capable to slice the integral piece into sliced sections, (d) a first driving means capable to impart motion to the slicing means, said motion is accompanied by slicing of the integral pieces into sliced sections, a means for discharging the sliced sections from the working area and for directing them to a second cutting unit capable to effect a cutting action to cut the sliced sections into a plurality of smaller pieces, said cutting unit being provided with a working table, adapted to receive the sliced sections discharged from the first cutting unit, said table being rotatable and indexable so as to expose said sections successively to a cutting action along at least two non parallel cutting directions, a second cutting unit for effecting said cutting action, said second cutting unit having a plurality of parallel cutting knives residing within a base frame, said base frame being mounted above said working table in a manner that allows said base frame to approach the sliced sections and to effect the cutting action along a cutting direction, a second driving means capable to impart to the base frame linear reciprocating motion accompanied by multiple cutting action, of said sliced sections effected by the plurality of said knives, in which said first cutting unit resides above the said second cutting unit, and, in which said working table is provided with a plurality of perforations, said perforations are connected with a source of vacuum for holding the sliced pieces firmly on the table during the cutting action.

18. An apparatus for cutting an integral piece of a fruit or vegetable into smaller separate pieces, said apparatus comprising:

a first cutting unit capable of preliminary slicing the integral piece into sliced sections, said unit being provided with (a) a working area into which the integral piece is fed (b) a holding means for stationary holding the integral piece within the working area (c) a first cutting unit provided with a slicing means capable to slice the integral piece into sliced sections, (d) a first driving means capable to impart motion to the slicing means, said motion is accompanied by slicing of the integral pieces into sliced sections, a means for discharging the sliced sections from the working area and for directing them to a second cutting unit capable to effect a cutting action to cut the sliced sections into a plurality of smaller pieces, said cutting unit being provided with a working table adapted to receive the sliced sections discharged from the first cutting unit, said table being rotatable and indexable so as to expose said sections successively to a cutting action along at least two non parallel cutting directions, a second cutting unit for effecting said cutting action, said second cutting unit having a plurality of parallel cutting knives residing within a base frame, said base frame being mounted above said working table in a manner that allows said base frame to approach the sliced sections and to effect the cutting action along a cutting direction, a second driving means capable to impart to the base frame linear reciprocating motion accompanied by multiple cutting action of said sliced sections effected by the plurality of said knives, in which said second cutting unit is provided with a means for variation of the distance between the planes of adjacent knives.

19. An apparatus for cutting an integral piece of a fruit or vegetable into smaller separate pieces, said apparatus comprising:

a first cutting unit capable of preliminary slicing the integral piece into sliced sections, said unit being provided with (a) a working area into which the integral piece is fed (b) a holding means for stationary holding the integral piece within the working area (c) a first cutting unit provided with a slicing means capable to slice the integral piece into sliced sections, (d) a first driving means capable to impart motion to the slicing means, said motion is accompanied by slicing of the integral pieces into sliced sections, a means for discharging the sliced sections from the working area and for directing them to a second cutting unit capable to effect a cutting action to cut the sliced sections into a plurality of smaller pieces, said cutting unit being provided with a working table adapted to receive the sliced sections discharged from the first cutting unit, said table being rotatable and indexable so as to expose said sections successively to a cutting action along at least two non parallel cutting directions, a second cutting unit for effecting said cutting action, said second cutting unit having a plurality of parallel cutting knives residing within a base frame, said base frame being mounted above said working table in a manner that allows said base frame to approach the sliced sections and to effect the cutting action along a cutting direction, a second driving means capable to impart to the base frame linear reciprocating motion accompanied by multiple cutting action of said sliced sections effected by the plurality of said knives, in which the first cutting unit is provided with (a) a transporting means adapted to advance the piece to be cut towards the working area, and, (b) a feeding means adapted to advance the piece within the working area, said slicing means is formed as a slicing blade connectable to a frame, said blade is slanted with respect to the plane of the working area, wherein said first driving means is capable to impart linear reciprocating motion to said slicing blade to approach the integral piece and to slice thereof into separate sections, said first driving means is capable to accelerate the said motion after the integral piece is approached, the apparatus further comprising (c) a third driving means capable to rotate said working table and to index thereof in the working position, and, (d) a control means for programmed operation of the apparatus, in which said transporting means comprises a conveyer with secured thereon plurality of compartments adapted to receive therein integral pieces to be sliced, said conveyer being driven by a motor.

* * * * *